US009290977B2

(12) United States Patent
Haab et al.

(10) Patent No.: US 9,290,977 B2
(45) Date of Patent: Mar. 22, 2016

(54) GUIDING DEVICE, CARRIAGE AND RUNNING RAIL

(71) Applicant: HAWA AG, Mettmenstetten (CH)

(72) Inventors: Gregor Haab, Allenwinden (CH); Peter Ettmuller, Jonen (CH); Myrta Kappeler, Muri (CH)

(73) Assignee: HAWA AG, Mettmenstetten (CH)

( * ) Notice: Subject to any disclaimer, the term of this patent is extended or adjusted under 35 U.S.C. 154(b) by 0 days.

(21) Appl. No.: 13/917,211

(22) Filed: Jun. 13, 2013

(65) Prior Publication Data

US 2014/0013543 A1 Jan. 16, 2014

(30) Foreign Application Priority Data

Jul. 11, 2012 (EP) ..... 12176035

(51) Int. Cl.
*E05D 15/06* (2006.01)
*E05D 15/16* (2006.01)
*E05D 15/10* (2006.01)

(52) U.S. Cl.
CPC ..... *E05D 15/0652* (2013.01); *E05D 15/1021* (2013.01); *E05D 15/0639* (2013.01); *E05D 15/0665* (2013.01); *E05Y 2201/69* (2013.01); *E05Y 2800/12* (2013.01); *E05Y 2800/672* (2013.01); *E05Y 2900/132* (2013.01); *Y10T 16/379* (2015.01)

(58) Field of Classification Search
CPC ... E05D 15/0652; E05D 15/063; E05D 15/12; E05D 15/0669; A47H 2023/025; E05Y 2900/132; B61D 19/005
USPC ..... 16/96 R, 94 R, 91, 106, 90, 97, 98; 160/196.1, 197, 199, 200; 49/409, 410, 49/425
See application file for complete search history.

(56) References Cited

U.S. PATENT DOCUMENTS

| | | | | | |
|---|---|---|---|---|---|
| 1,921,193 | A | * | 8/1933 | Kelly | 160/209 |
| 1,948,065 | A | * | 2/1934 | Clark | 160/209 |
| 1,990,470 | A | * | 2/1935 | Clark | 160/191 |
| 1,990,870 | A | * | 2/1935 | Kelly | 160/194 |
| 2,827,114 | A | * | 3/1958 | Stroup | 160/209 |
| 3,193,870 | A | * | 7/1965 | McNinch | 16/97 |
| 3,334,442 | A | * | 8/1967 | Boettcher | 49/231 |
| 3,525,306 | A | * | 8/1970 | Bubic et al. | 104/95 |
| 3,611,637 | A | * | 10/1971 | Saino | 9/235 |
| 3,793,673 | A | * | 2/1974 | Lawrence, Jr. | 16/97 |
| 3,813,728 | A | * | 6/1974 | Johnson | 16/97 |
| 4,199,133 | A | * | 4/1980 | Gagnon et al. | 472/78 |
| 4,229,857 | A | * | 10/1980 | Toder | 16/95 R |
| 4,236,456 | A | * | 12/1980 | Schreyer et al. | 105/154 |
| 4,265,181 | A | * | 5/1981 | Schreyer et al. | 105/150 |
| 4,476,652 | A | * | 10/1984 | Beauchot | 49/235 |
| 4,619,075 | A | * | 10/1986 | Wiles | 49/235 |
| 4,628,719 | A | * | 12/1986 | Best | 72/257 |
| 4,651,469 | A | * | 3/1987 | Ngian et al. | 49/223 |
| 4,680,828 | A | * | 7/1987 | Cook et al. | 16/90 |

(Continued)

*Primary Examiner* — Victor Batson
*Assistant Examiner* — Jason W San
(74) *Attorney, Agent, or Firm* — Oliff PLC

(57) ABSTRACT

The guiding device, which serves for guiding a sliding element, such as a sliding door provided with a door leaf, with which a room opening of a building part can be closed at least approximately tightly, comprises a running rail having a longitudinal axis and at least one carriage that is guided along the running rail and that comprises a carriage body that is connected to a coupling device that is coupled or can be coupled with the sliding element.

16 Claims, 19 Drawing Sheets

(56) References Cited

U.S. PATENT DOCUMENTS

Figure 1:
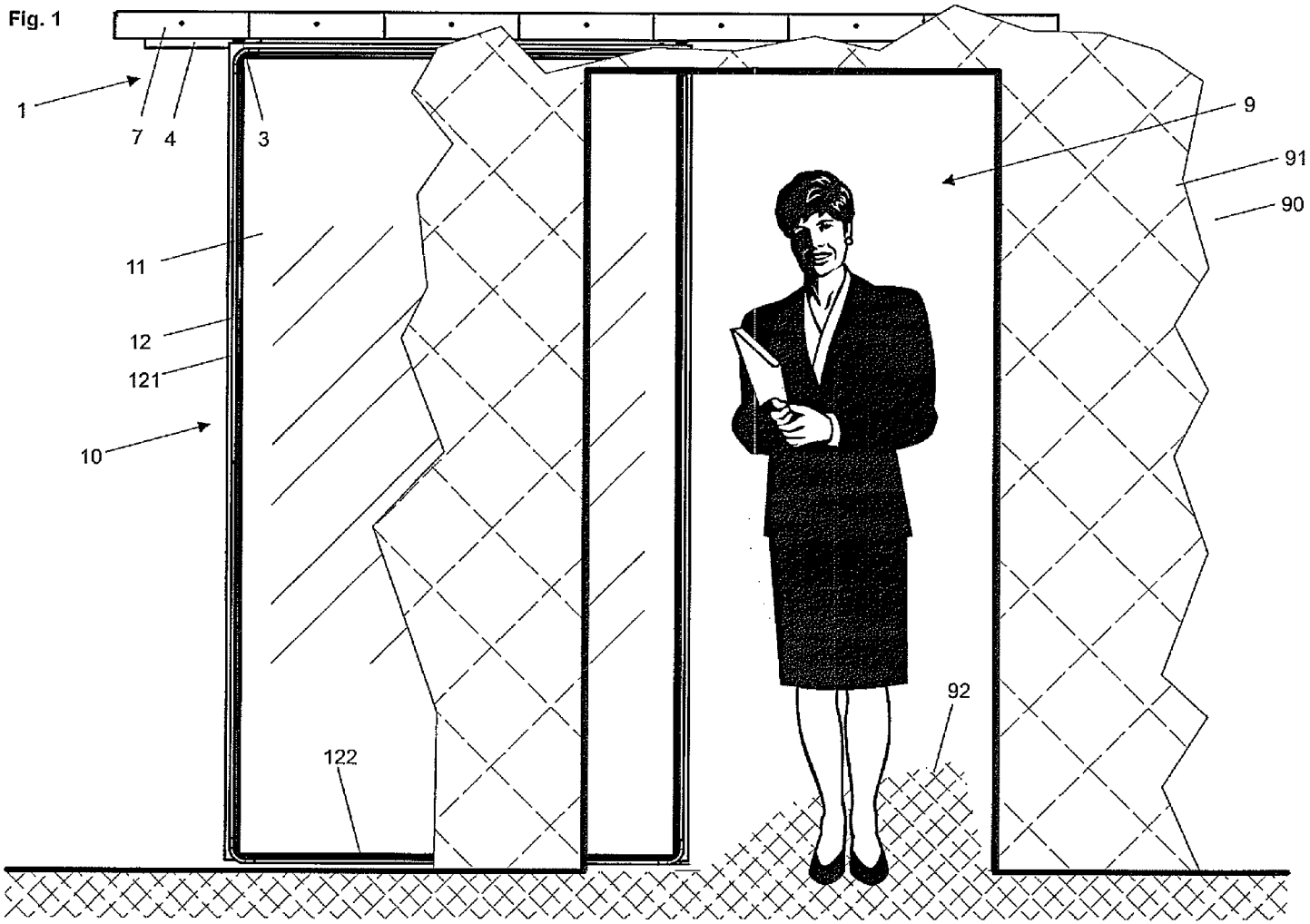

| | | | | |
|---|---|---|---|---|
| 4,852,628 | A * | 8/1989 | Klein | 160/199 |
| 5,076,018 | A * | 12/1991 | Gianfranco | 49/410 |
| 5,301,468 | A * | 4/1994 | Kamezaki | 49/225 |
| 6,047,761 | A * | 4/2000 | Jaehnen et al. | 160/201 |
| 6,052,867 | A * | 4/2000 | Haab et al. | 16/87.6 R |
| 6,082,499 | A * | 7/2000 | O'Donnell | 187/324 |
| 6,209,171 | B1 * | 4/2001 | Pelletier et al. | 16/97 |
| 6,330,763 | B1 * | 12/2001 | Kern et al. | 49/231 |
| 6,374,456 | B1 * | 4/2002 | Fort et al. | 16/96 R |
| 6,463,625 | B2 * | 10/2002 | Mittag | 16/97 |
| 6,647,590 | B2 * | 11/2003 | Haab et al. | 16/90 |
| 6,745,813 | B2 * | 6/2004 | Yorgason | 160/199 |
| 6,928,696 | B2 * | 8/2005 | Wartman | 16/99 |
| 6,983,512 | B2 * | 1/2006 | De Oliveira | 16/97 |
| 7,367,159 | B2 * | 5/2008 | Delgado et al. | 49/120 |
| 7,891,052 | B2 * | 2/2011 | Haab et al. | 16/98 |
| 8,336,972 | B2 * | 12/2012 | Haab et al. | 312/322 |
| 8,393,114 | B2 * | 3/2013 | Haab et al. | 49/425 |
| 2002/0170234 | A1 * | 11/2002 | Salice | 49/453 |
| 2004/0003484 | A1 * | 1/2004 | D'Assumcao | 16/91 |
| 2006/0150518 | A1 * | 7/2006 | Van 't Zelfde et al. | 49/409 |
| 2007/0227074 | A1 * | 10/2007 | Frank | 49/409 |
| 2008/0115329 | A1 * | 5/2008 | Liao | 16/96 R |
| 2010/0242370 | A1 * | 9/2010 | Trulaske, Sr. | 49/410 |
| 2011/0061303 | A1 * | 3/2011 | Peterson | 49/197 |
| 2011/0314634 | A1 * | 12/2011 | Liebscher et al. | 16/91 |
| 2012/0110788 | A1 * | 5/2012 | Chen | 16/94 R |
| 2013/0020035 | A1 * | 1/2013 | Pelakanos | 160/181 |
| 2013/0127603 | A1 * | 5/2013 | Choo et al. | 340/12.5 |
| 2013/0239368 | A1 * | 9/2013 | Watson | 16/96 R |
| 2013/0276373 | A1 * | 10/2013 | Haab et al. | 49/360 |

* cited by examiner 3
33
32
31
2
24
12
11
10
25
13
23
22
231
21

1
2
7A
7
7B
10
121
12
11
122
123
111

1
2
3
4
23
24
25
31
32
33
41
42
421
422
43
431
80
x
v
-45° + kw
+45° + kw 3
33
32
31
251
252
25
24
2
231
241
27
26
23
230

3
33
32
31
4
1
2
43
71
72
7

27
24
262
261
26

532
511
531
52
53
51
5
55
5B 653
652
651
65
61

5A
6
62
5B
11
111
65
61
16
12, 122
10
6
5A
62
1210
1220
120

GUIDING DEVICE, CARRIAGE AND RUNNING RAIL

The invention relates to a guiding device for a sliding element, particularly a sliding door, that is slidable along a running rail, and with which a room opening can be closed. The invention relates further to a carriage and to a running rail for this guiding device.

For separating or creating rooms or for closing openings of rooms or windows, often sliding elements are used, such as sliding doors made from glass or wood, which typically are guided with two carriages along a running rail. E.g., from [1], U.S. Pat. No. 7,891,052B2, a device is known with a carriage that can be guided along a running rail and that serves for holding a glass panel or a sliding door made of glass, respectively. The carriage is connectable to the glass panel by means of fittings, so that the upper edge of the glass panel can be received within the cross-section of the running rail. This allows partial closing of the space between the glass panel and the running rail, so that, when the sliding door is closed an improved reduction of the noise is achieved that passes through the opening closed by the sliding door into the separated room.

However, noise reduction and further media insulation that can be achieved with this sliding door, is not compatible with the insulation that can be achieved with pivotally held doors that however exhibit different disadvantages.

The present invention is therefore based on the object of creating an improved guiding device for a sliding element, particularly a sliding door. In particular, a guiding device for a sliding element shall be created, with which an opening can be closed tightly, particularly soundproof. Further, a carriage and a running rail for such a guiding device shall be defined.

The guiding device, which serves for guiding a sliding element, such as a sliding door provided with a door leaf, with which a room opening of a building part can be closed at least approximately tightly, comprises a running rail having a longitudinal axis and at least one carriage that is guided along the running rail and that comprises a carriage body that is connected to a coupling device that is coupled or can be coupled with the sliding element.

Preferably, the sliding element, which comprises a door leaf made of wood, glass, plastic or metal, is held by of two carriages. For coupling the carriages to the sliding element, appropriate fittings are provided on the door leaf.

According to the invention, the running rail comprises a first and a second track that run in parallel and that are inclined towards one another. The carriage body holds first and second running elements that are inclined towards one another and that are supported by the corresponding first or second track, whereby at least one of said first and second tracks comprises a first track section running in parallel to the longitudinal axis and a second track section, along which the carriage can be driven into a terminal position, running inclined to the longitudinal axis.

In this way, with a simple construction of the carriage, it can be ensured that the carriage can be guided along the longitudinal axis of the running rail and then can be driven in at least one end region of the running rail inclined to the longitudinal axis, i.e. particularly against the room opening. Thereby, the running elements are in every position along the running rail in optimal contact with the tracks. With a corresponding inclination of the running rail it can be reached that the first running elements carry a substantial part of the load of the sliding element, while the second running elements serve for laterally guiding the sliding element and receive only a small part of the load. In principle, the inclination of the running rail can be selected freely. Preferably the first and second tracks, which are facing the ceiling, are inclined by +45° and −45°, respectively, against the vertical line or the plane of the sliding door, whereby a correction angle, that lies in the range from −25° to +45°, can be added, in order to increase or reduce the horizontal or vertical deflection of the sliding door accordingly.

The first and second running elements, which preferably are provided in pairs, are preferably track rollers, wheels, gliding elements or magnet elements. Combinations of different running technologies can advantageously be applied. E.g., for the first running elements a low noise magnetic running technology or sliding technology is used, while for the second running elements rollers or wheels are applied. The running surfaces of the running elements seated on the tracks of the running rail, which are inclined towards one another, enclose preferably the same inclination angle as the tracks of the running rail and preferably are arranged in a distance of 0.5 cm-3 cm near one another, which allows a compact construction of the carriage.

In a first preferred embodiment the carriage is therefore not guided along a straight line, but in a plane that is defined by the first track of the running rail. The way the carriage passes within this plane is defined by the second track, which, in the manner of a link mechanism, comprises at least the two track sections that are inclined towards one another.

The plane, on which the carriage is driven, is therefore defined by the inclination of the running rail and the first track, respectively, which comprises only one track section. The deviations of the path, the carriage passes within this plane, are determined, by the slope of the second track or the slope of the track sections, respectively.

Hence, with the inventive guiding device a sliding door can be moved not only in linear direction, but as desired laterally and vertically. The amount by which the sliding door is laterally moved when sliding along the second track section and the amount by which sliding door is vertically moved when sliding along the second track section or the second track sections can be adjusted by selecting the inclination of the running rail and the track sections. This calibration can either be defined at factory side or installation side. In order to allow the carriage to pass a defined pathway without obstruction, the connection between the carriage body and the sliding door comprises at least one pivot. The carriage shall be able to incline or turn, while the alignment of the sliding door shall remain unchanged.

In order to ensure that two carriages can execute identical movements, e.g. on a common first track in a common plane, identical second tracks, if appropriate identical rail segments are provided for both carriages, which are synchronously travelled by the carriages. A sliding door suspended on both carriages is therefore moved in parallel to the room opening when the carriages are deflected. In a preferred embodiment, corresponding guiding elements are provided at the lower side of the sliding door, which support the described closing procedure.

Hence, the sliding door can optionally be moved along a straight line and then laterally towards a room opening and be lowered, in order to tightly close the room opening. The second track forms a link mechanism with a horizontal first track section and with a second track section inclined downwards, which is driven through buying the related carriage when the sliding element is closed.

In a further embodiment, both tracks are provided with second track sections that are inclined relative to the longitudinal axis of the running rail. Hence, in this case, the carriage no longer drives within a plane, but along the two second track sections in the terminal position. In this way a further degree of freedom results for the selection of the track, along which the sliding element is driven into the terminal position. E.g., the carriage can be driven to a side, while avoiding a vertical movement. However, also in this case it is possible, that the sliding element is lifted or lowered while driving into the terminal position.

Thereby it can be arranged that the sliding door completely traverses the distance to a wall only or the distance to the floor only and thus abuts in the terminal position the wall and/or the floor. Hence, the guiding device can be adjusted on factory side or installation side in such a way that the sliding door abuts in the terminal position the wall or the frame bordering the room opening at a desired position and/or the floor.

In further preferred embodiments, additional second track sections can be provided on the one or the other end of the running rail or the rail segments. The second track sections can also be curved.

The inclination the first and second track of each rail segment and the inclinations the second track sections versus the first track sections are selected in such a way, that the sliding element traverses within a closing path, that corresponds to the length of the second track section, a distance between the front side the sliding door and the edge of the room opening and a distance between the lower side of the sliding door and the floor.

The inventive guiding device therefore allows tightly closing a room opening on all sides. In order to reach an optimal sealing also in view of further media and to avoid collisions of the sliding door, the sliding door is preferably provided with a sealing gasket on the front side facing the room opening or on the frame or edge of the room opening. This sealing gasket runs along the edge of the sliding door or the door leaf, respectively, and, if a sealing towards the floor is required, overlaps the lower side of the door leaf. The sealing gasket runs preferably in one piece in a closed loop along the periphery of the door leaf. Alternatively, sealing elements can be assembled. The sealing gasket preferably consists of an elastic element, which comprises a compressible hollow body, preferably a bellow. However, any other sealing, such as a sealing gasket with an elastic sealing lip can be used.

It is further possible, to apply a sealing on at least one side of the door leaf only, e.g. on the lower side and/or upper side. Alternatively, it is possible to apply said sealing or sealing elements not on the door leaf, but on the building side.

Further, the carriages can be motorised, so that the sliding door can automatically be operated and can be driven with higher force into the terminal position, thus increasing the contact pressure exerted onto the sealing gasket.

The running rail can be manufactured in one piece or can be separated in rail segments, which are subsequently mounted behind one another or side-by-side. Thereby the lengths of the rail segments is selected in such a way that, when moving the carriages along the rail segments, a room opening can be opened or closed completely with the sliding door held by the carriages. E.g., a running rail can be split into two rail segments and can be installed at installation site by means of a mounting profile that preferably is assembled from several identical parts. Hence, the individual parts of the guiding device can be packed up at factory site with reduced space requirement and can be assembled and set up at installation site. If the second tracks of the running rail are arranged behind one another, then the carriages run only within the related second track and cannot get into the range of neighbouring second tracks. However, a running rail can be provided with second tracks that overlap one another. A plurality of second tracks is preferably arranged side-by-side. As well, rail segments can be arranged side-by-side. To allow each carriage to drive through the overlapping second track with the second rollers, the second rollers are mounted in a corresponding distance. Preferably, the second shafts are provided with a corresponding length, allowing holding the second track rollers at least in a first or a second position above the assigned second track.

The running rail, which preferably consists of several rail segments, can be mounted above the sliding element or below the sliding element, whereby the tracks are directed towards the ceiling in each case. In the first case, the sliding element is suspended preferably on two carriages. In the second case the sliding element is supported by a running rail.

In spite of using a running rail with two tracks, the invention allows to construct the carriages in compact form with at least one first shaft for holding the at least one first running element and with at least one second shaft for holding the at least one second running element.

The carriages preferably comprise two carriage channels or wheel channels, respectively, inclined towards one another, in which the running elements or the track rollers, respectively, are held in such a way that they face the related tracks of the running rail and are seated on them, planar or linear.

The carriage channels preferably consist of two U-profiles connected with one another, with their sides facing one another connected with one another and preferably forming a part of a carriage body. However, the running elements can also be held by the carriage body only, which is designed accordingly.

For the purpose of connecting the carriage with the sliding element, a coupling device is provided that is connected with the carriage body, e.g. with one of the channel walls or the carriage block. If the sliding element is suspended on the running rail, then the coupling device extends into the range below the carriage. If the sliding element is supported by the running rail, then the coupling device is held above of the carriage.

If the carriage body comprises a carriage block, then the carriage block can advantageously be provided with body bores, which serve for receiving the first and second shafts. The shafts, which preferably comprise each a flange head and a piston, can be inserted into the body bores until the flange head abuts a collar adjoining the related body bore. The piston of each shaft extending out of the carriage body can be provided with a running element or with a track roller.

The carriage body and the sliding element, preferably the carriage body and the coupling device, are connected with one another by at least one pivot in order to allow the carriage to drive along the running rail without obstruction. Hence, the carriage can turn in the plane defined by the first track or along the two track sections without obstruction.

Further, the coupling device preferably comprises a coupling element, which holds the sliding element vertically aligned below or above and preferably between the pairs of first and second track rollers. In this manner the load of the sliding element is distributed equally onto both pairs of track rollers, thus avoiding the transmission of disturbing mechanical moments onto the running rail.

The pivot can advantageously be created by introducing a bore into the carriage body a preferably aligned in parallel to the second shafts. Into the bore a bearing bush is inserted, which comprises a flange ring that is held by a collar, which is adjoining the bore. In a preferred embodiment the bearing bush traverses the second wheel channel and is held on its end in a bore in the second wing element. A pivot pin that is provided with a flange head and that is connected to the coupling element can be inserted into the bearing bush and is rotatably seated there in. The carriage body can therefore freely turn relative to the coupling element. This embodiment of the pivot requires little space and can easily be made. However, alternative embodiments of the coupling device and the pivot can also be applied.

On the side opposite to the running rail, the sliding element is preferably provided with a guide element, with which the sliding door, also during the closing procedure, is always held in parallel to the room opening, so that the sliding door can be guided on each frame section with the same pressing force against the room opening, thus evenly compressing the sealing gasket provided on the sliding door or the wall. For this purpose on the related side of the sliding door or hidden in the floor a guide rail is provided, which comprises inclined guide sections that corresponds to the track sections of the running rail. A guide element, preferably a guide wheel of an adjustable carriage, engages in the guide rail, and ensures that the sliding door is moved according to the slope of the guide rail. If required, further options for the adjustment of the guide elements, e.g. with a vertical displacement of the guide elements, can be provided.

In a further preferred embodiment, the first carriage or a corresponding terminal stop is provided with a damping device, which ensures that the sliding door, with the support of gravity, can run automatically and smoothly into the terminal position. Due to the inclination of the second track sections in an automatic closing action can be achieved without the need for expensive drawing devices. The damping device preferably comprises a hydraulic damper. Further, an elastic element can advantageously be provided that absorbs kinetic and potential energy, which is set free by the sliding door during the drive into the terminal position. The damping device can also be mounted within the running rail. With the inventive solution and, if present, support of the energy stored in the damping device, the force for operating the sliding door, manually or with a motor, can be kept low.

Figure 2:
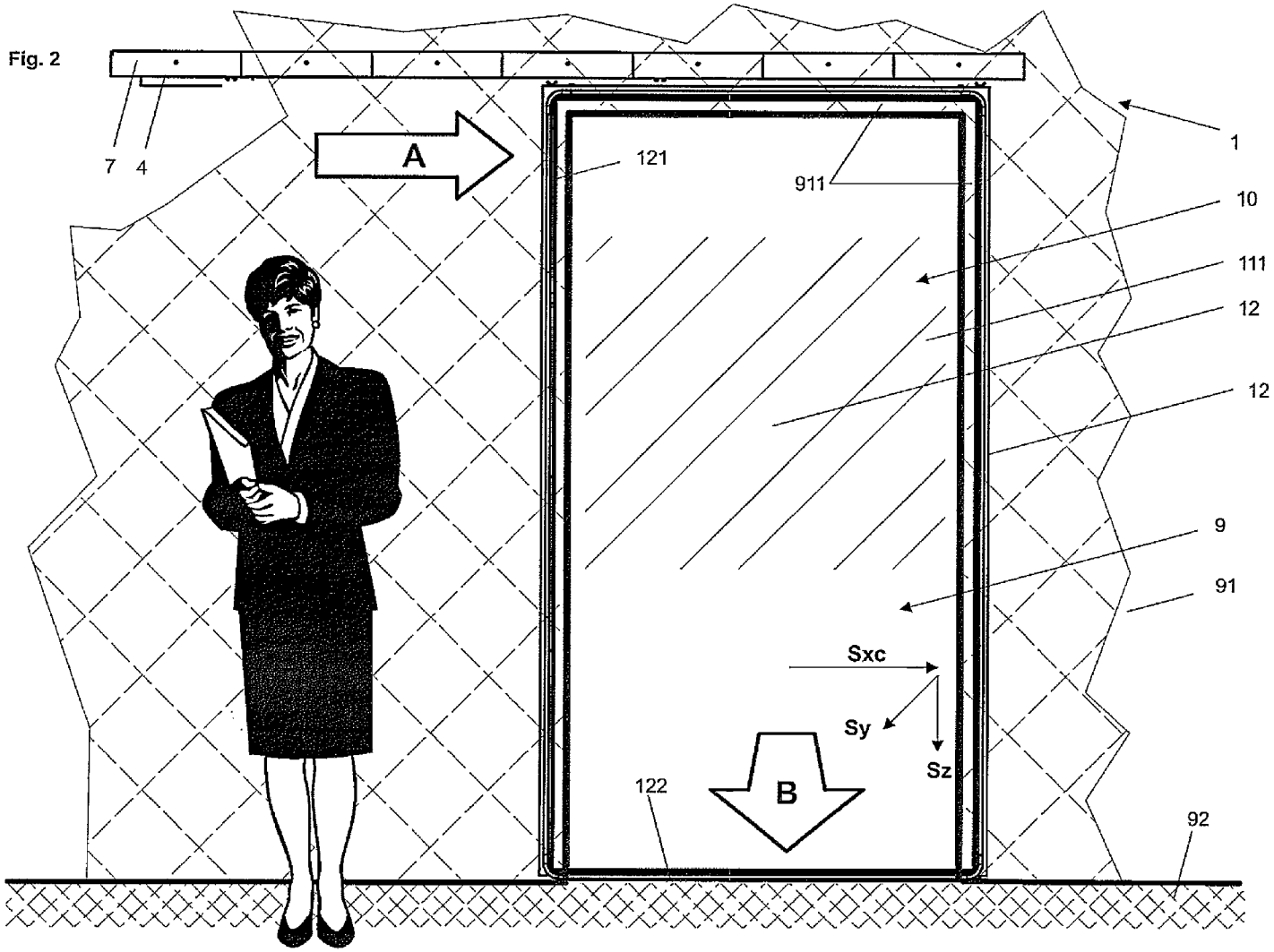
Figures 3, 4:
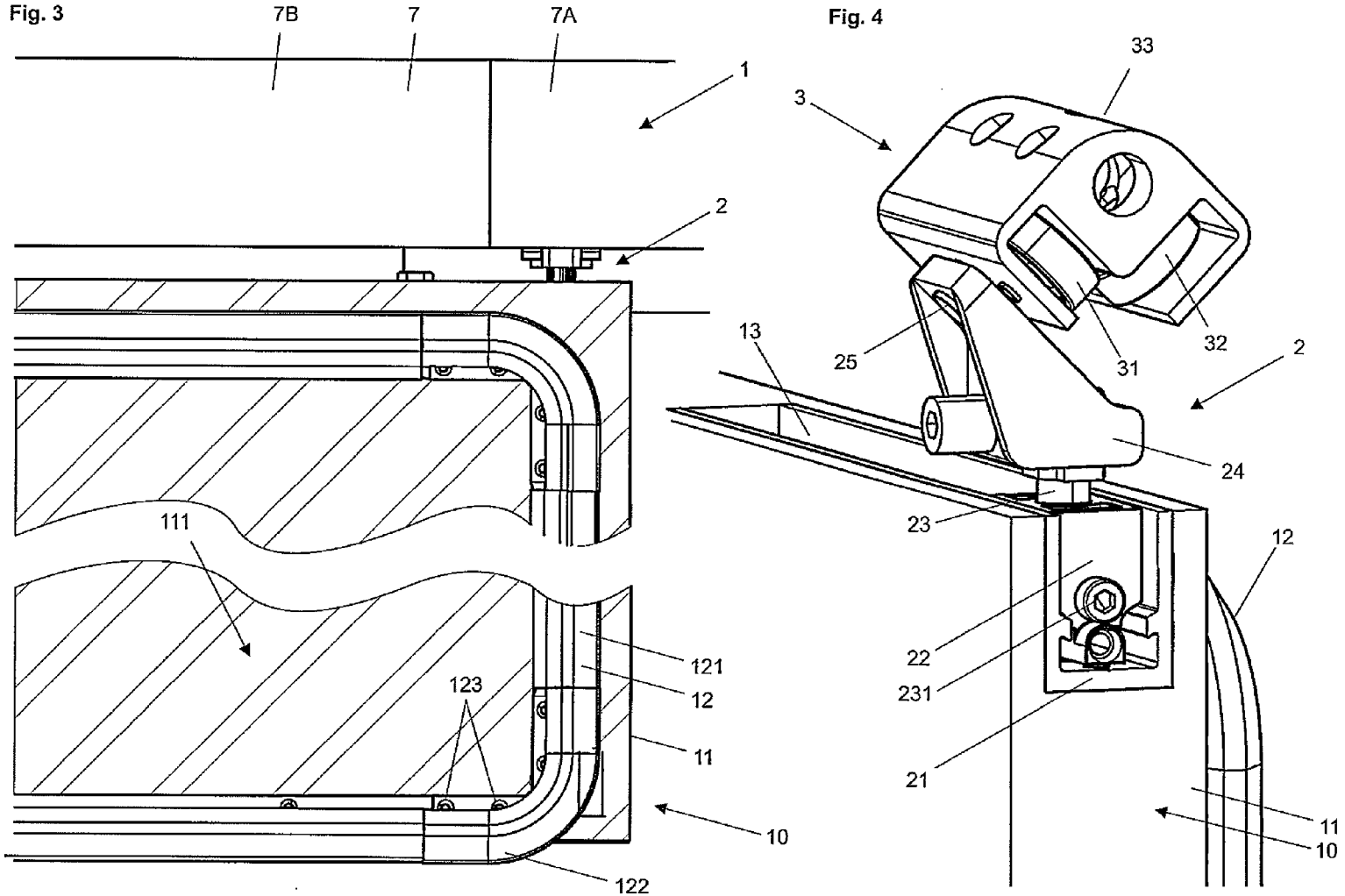
Figures 5A, 5B, 5C:
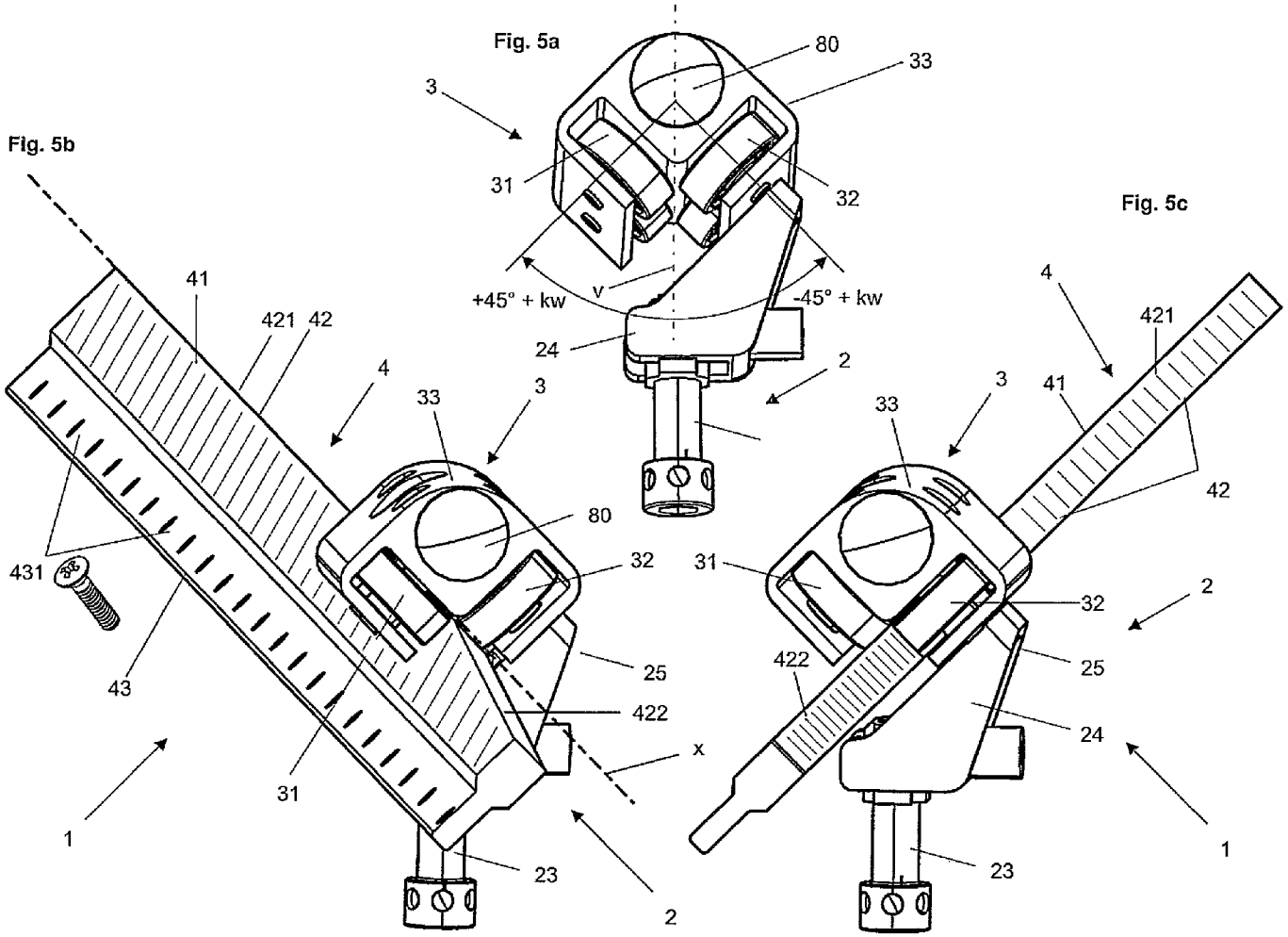
Figure 6:
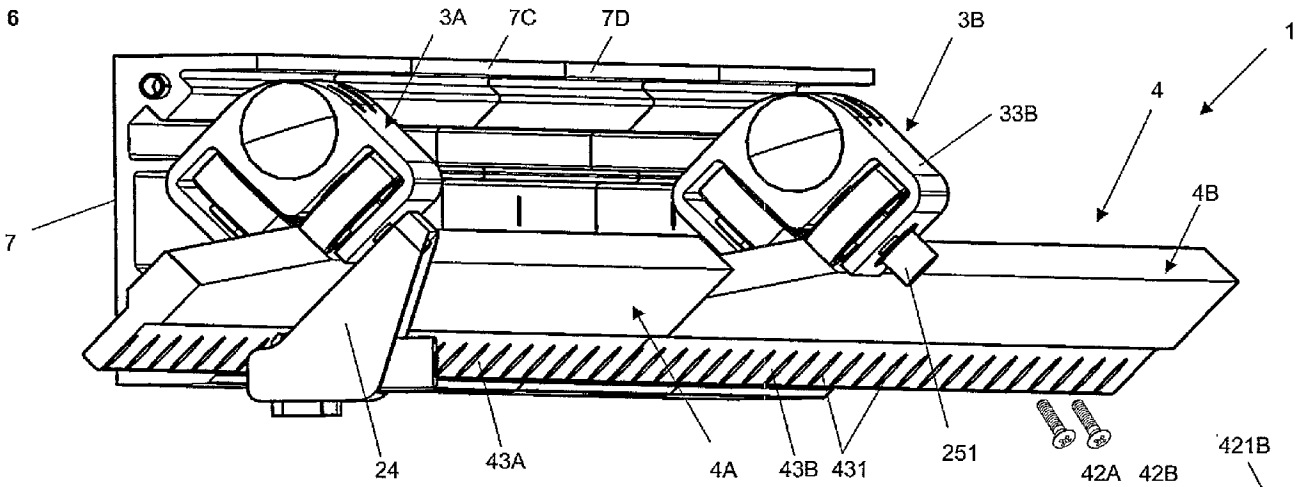

Below, the invention is described in detail with reference to the drawings. Thereby show:

FIG. 1 an inventive guiding device 1, with which a sliding door 10 provided with sealing elements 12 can be displaced in such a way, that a room opening 9 can be opened and tightly closed;

FIG. 2 the guiding device 1 of FIG. 1 with the sliding door 10 in the terminal position, in which the room opening 9 is tightly closed;

FIG. 3 the sliding door 10 of FIG. 1 with the front side 3 facing the room opening 9;

FIG. 4 the sliding door 10 of FIG. 3 that is pivotally connected via a coupling device 2 with the body 33 of an inventive carriage 3, which comprises two roller pairs 31, 32 aligned perpendicular to one another;

FIG. 5*a-c* the carriage 3 of FIG. 4 with a running rail 4 or a segment 4A of a running rail 4 with a first track 41 for supporting the first roller pair 31 and a second track 42 for supporting the second roller pair 32 that is aligned perpendicular to the first track 41 and that comprises two track sections 421, 422 inclined towards one another;

FIG. 6 an inventive guiding device 1 with two carriages 3A, 3B according to FIG. 5*a*, that are seated on rail segments 4A; 4B, of the running rail 4, which rail segments 4A; 4B are arranged behind one another as shown in FIG. 5*a;*

Figure 7:
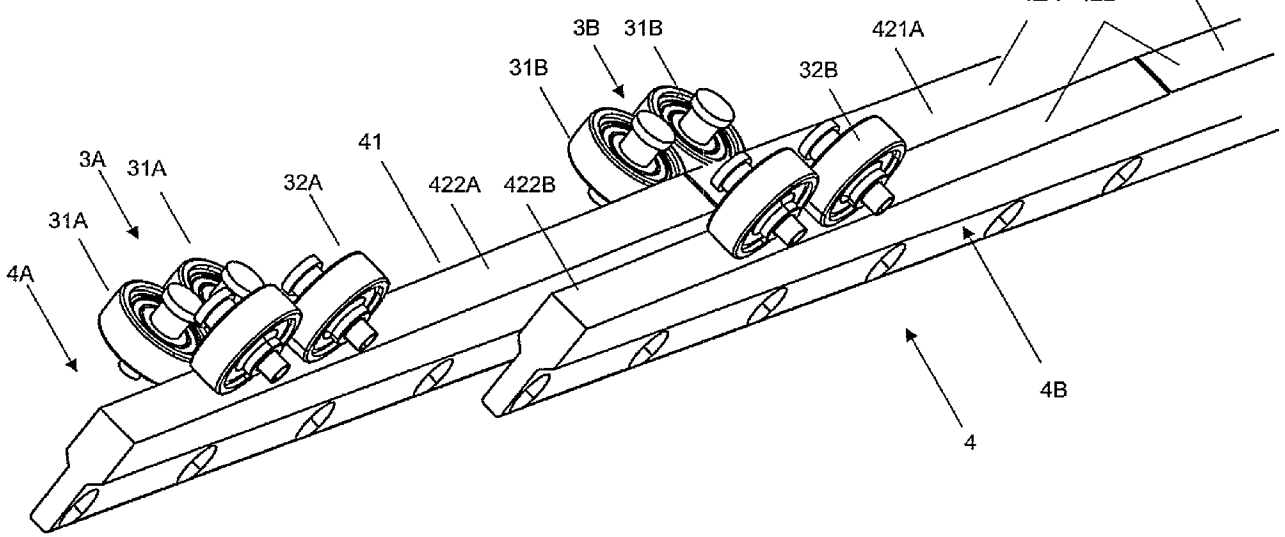
Figures 8, 9, 9A:
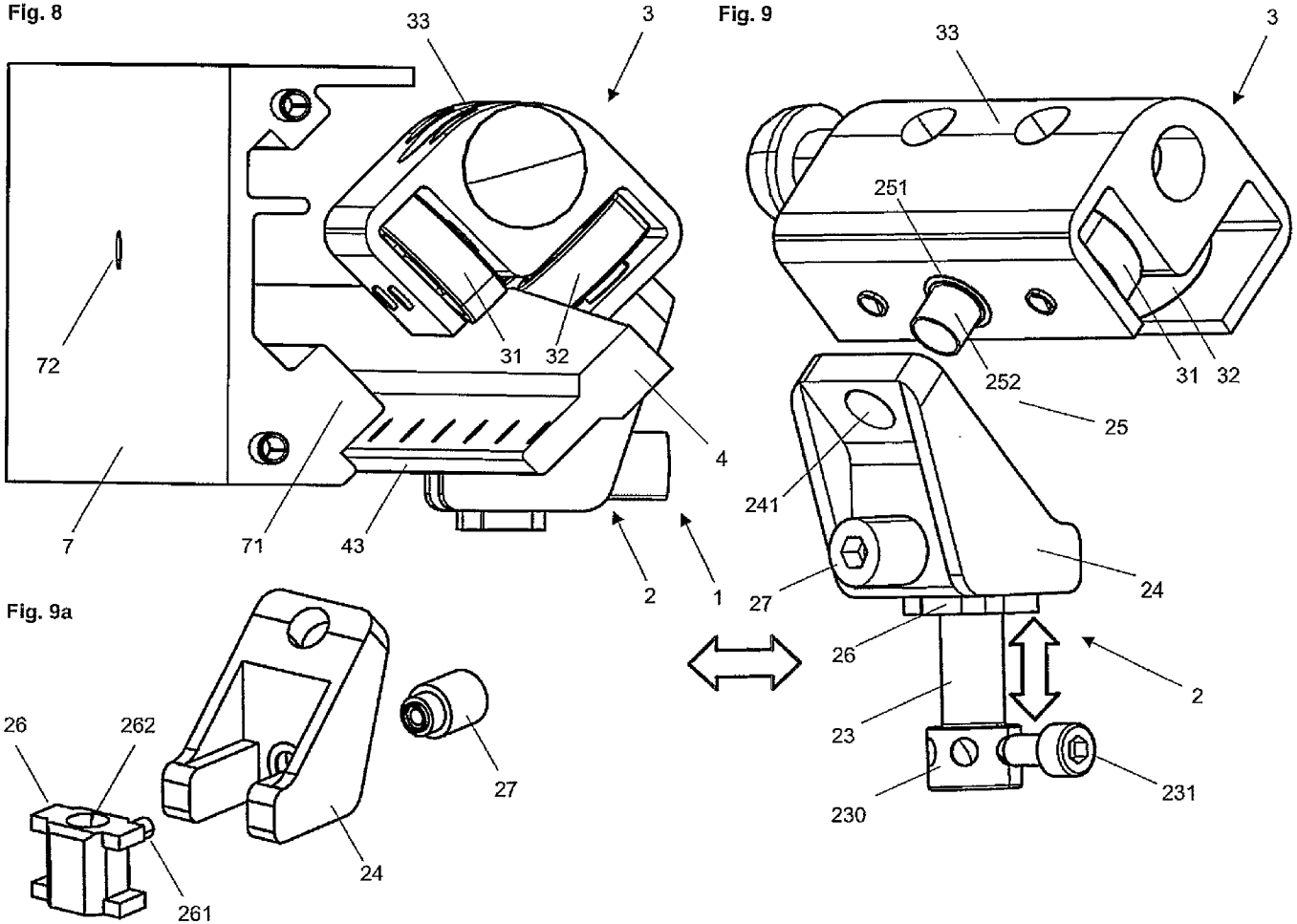
Figures 10A, 10B, 10C:
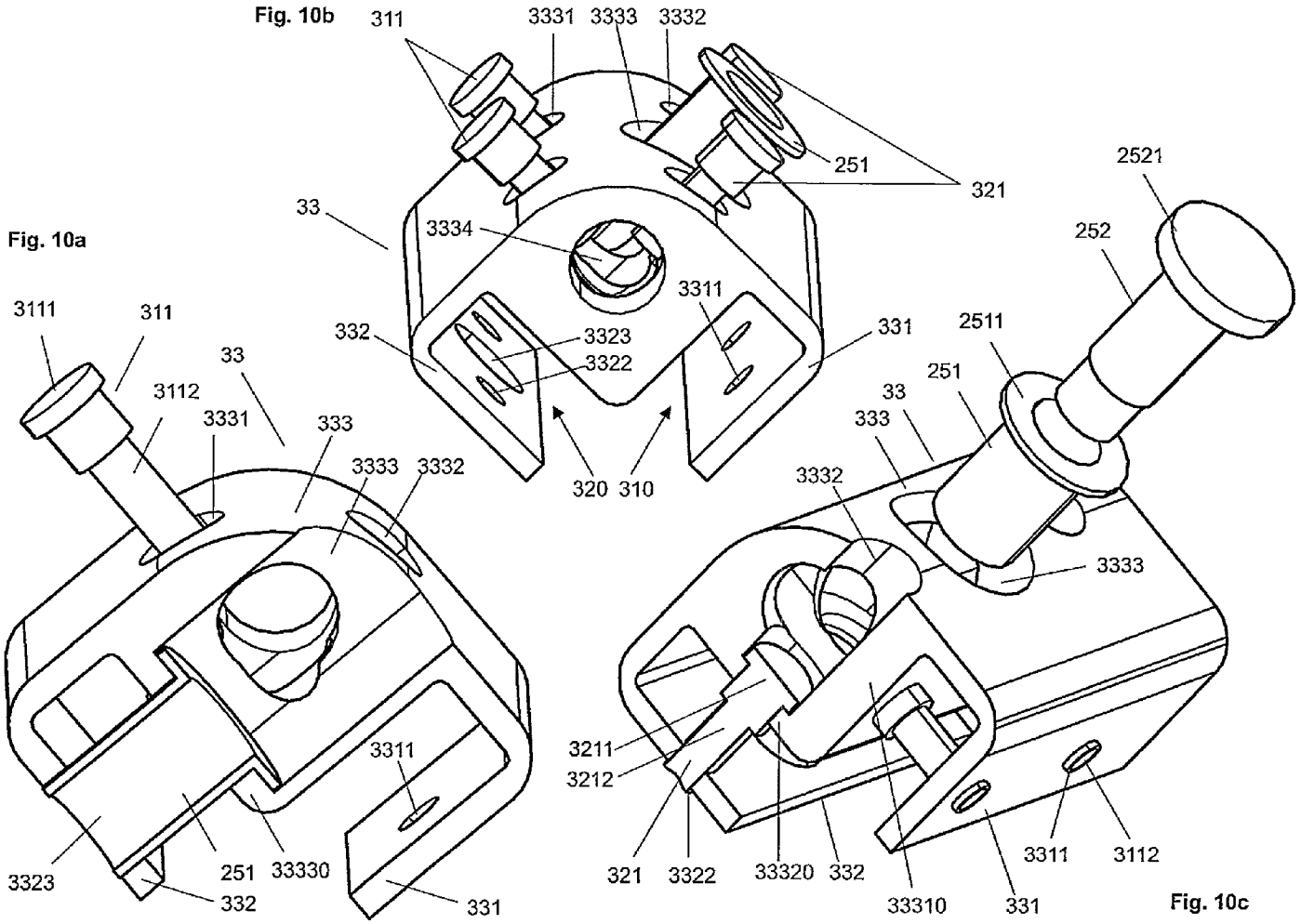
Figures 11, 11A, 11B, 11C, 11D:
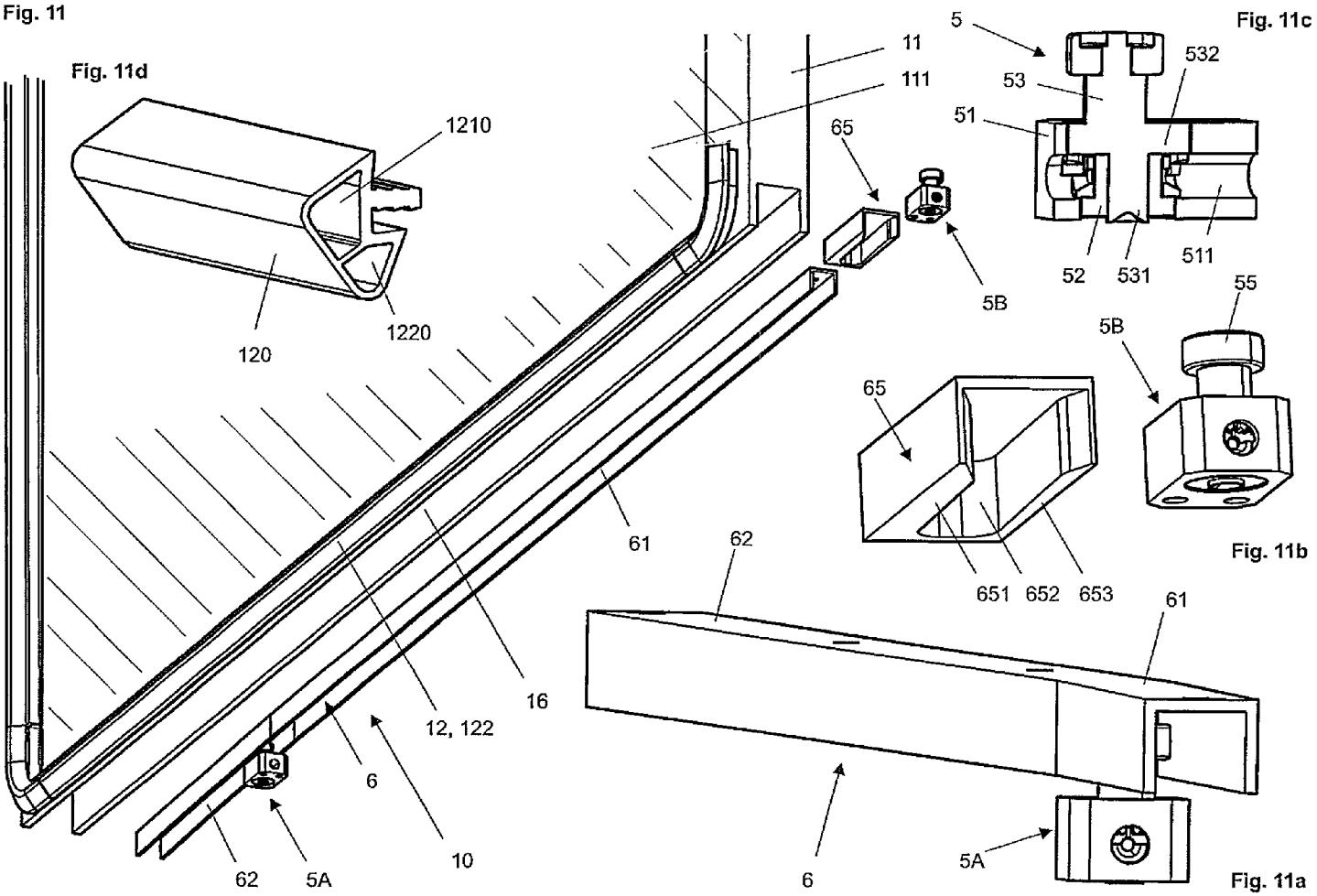
Figure 12A:
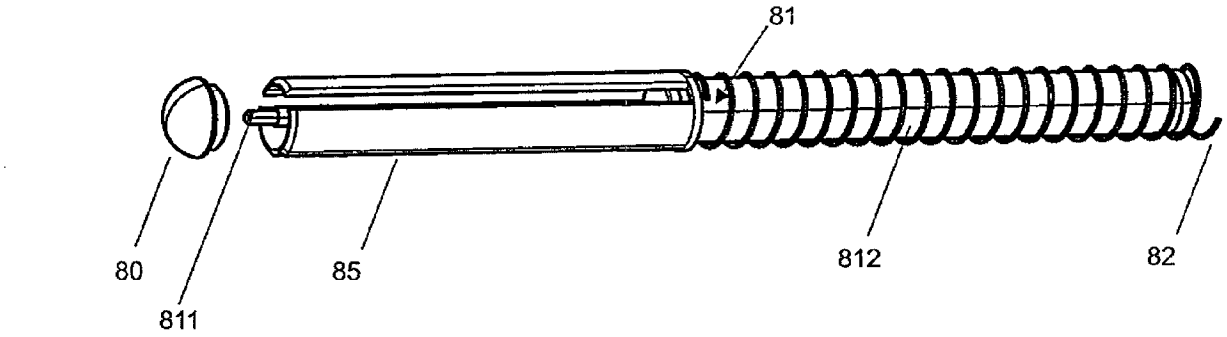
Figure 12:
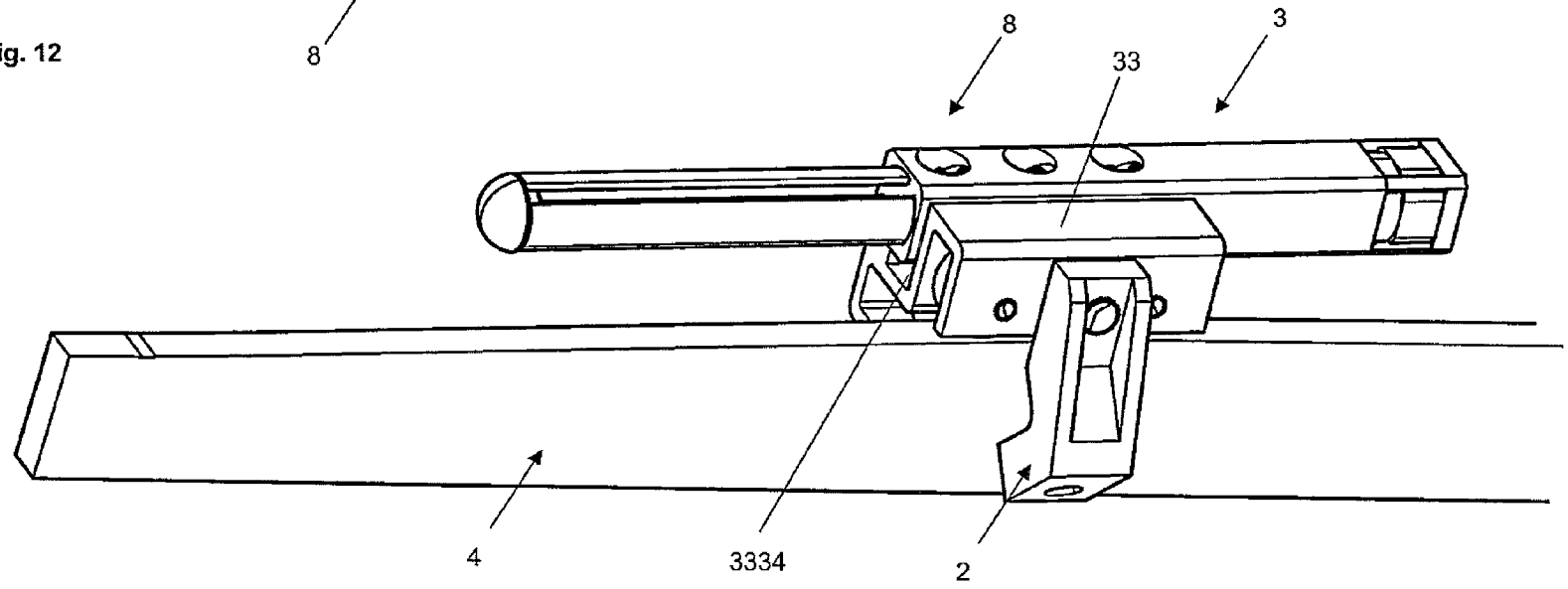
Figure 13C:
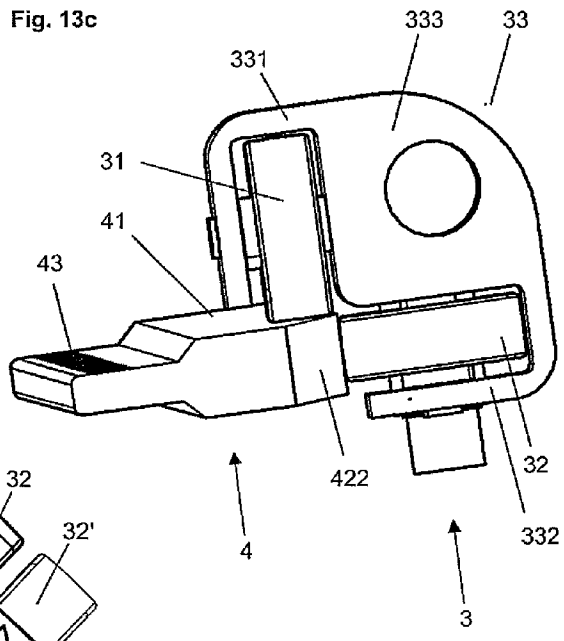
Figure 13B:
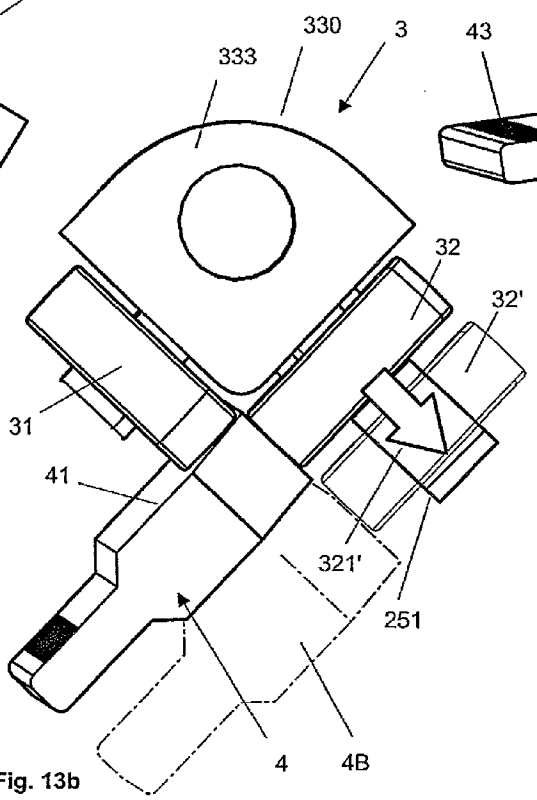
Figure 13A:
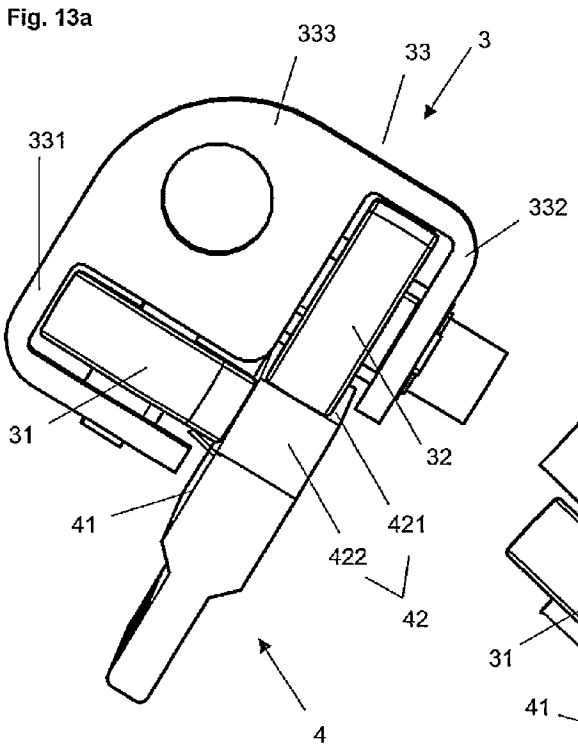
Figures 14A, 14B, 15:
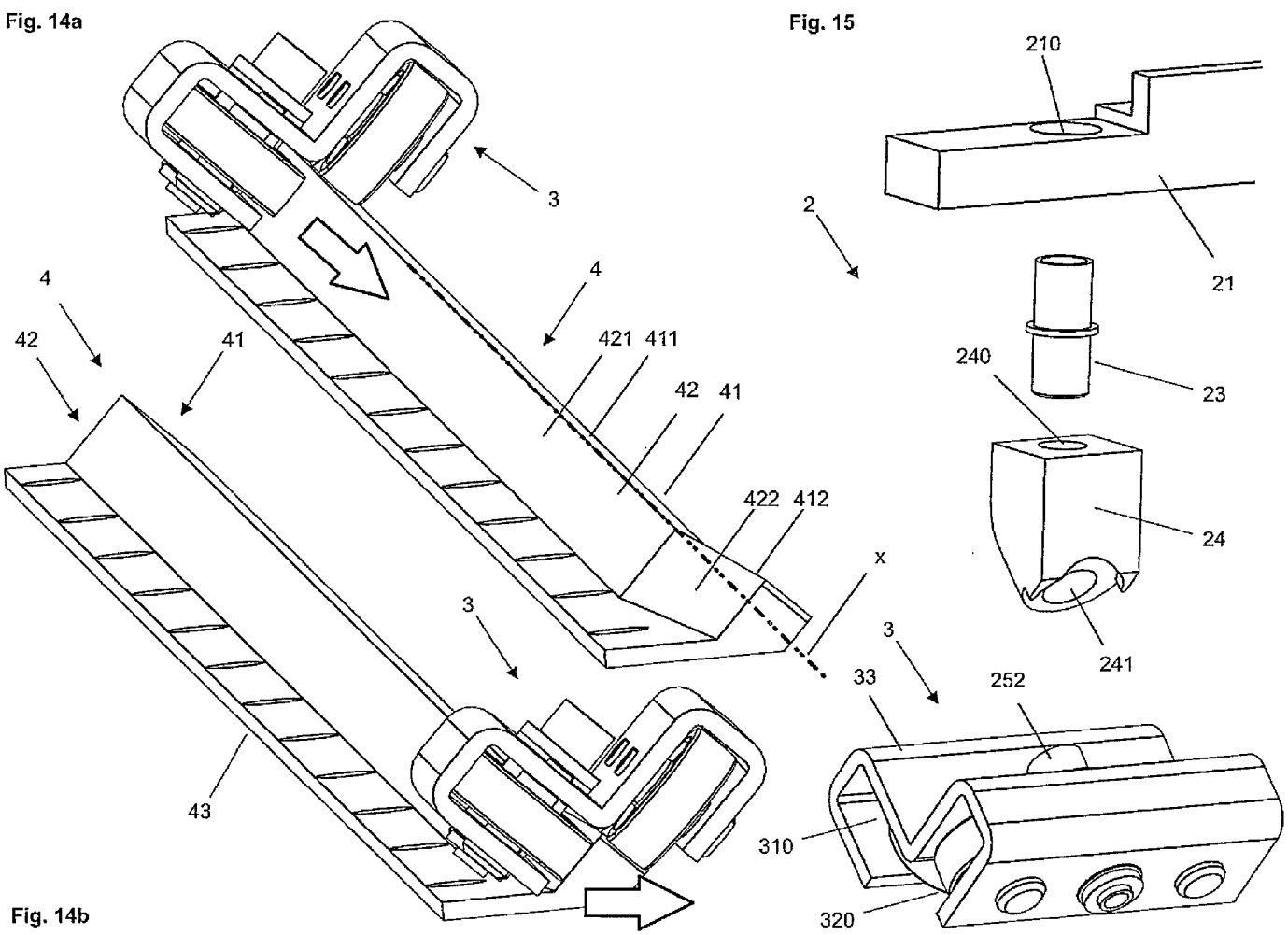
Figure 16:
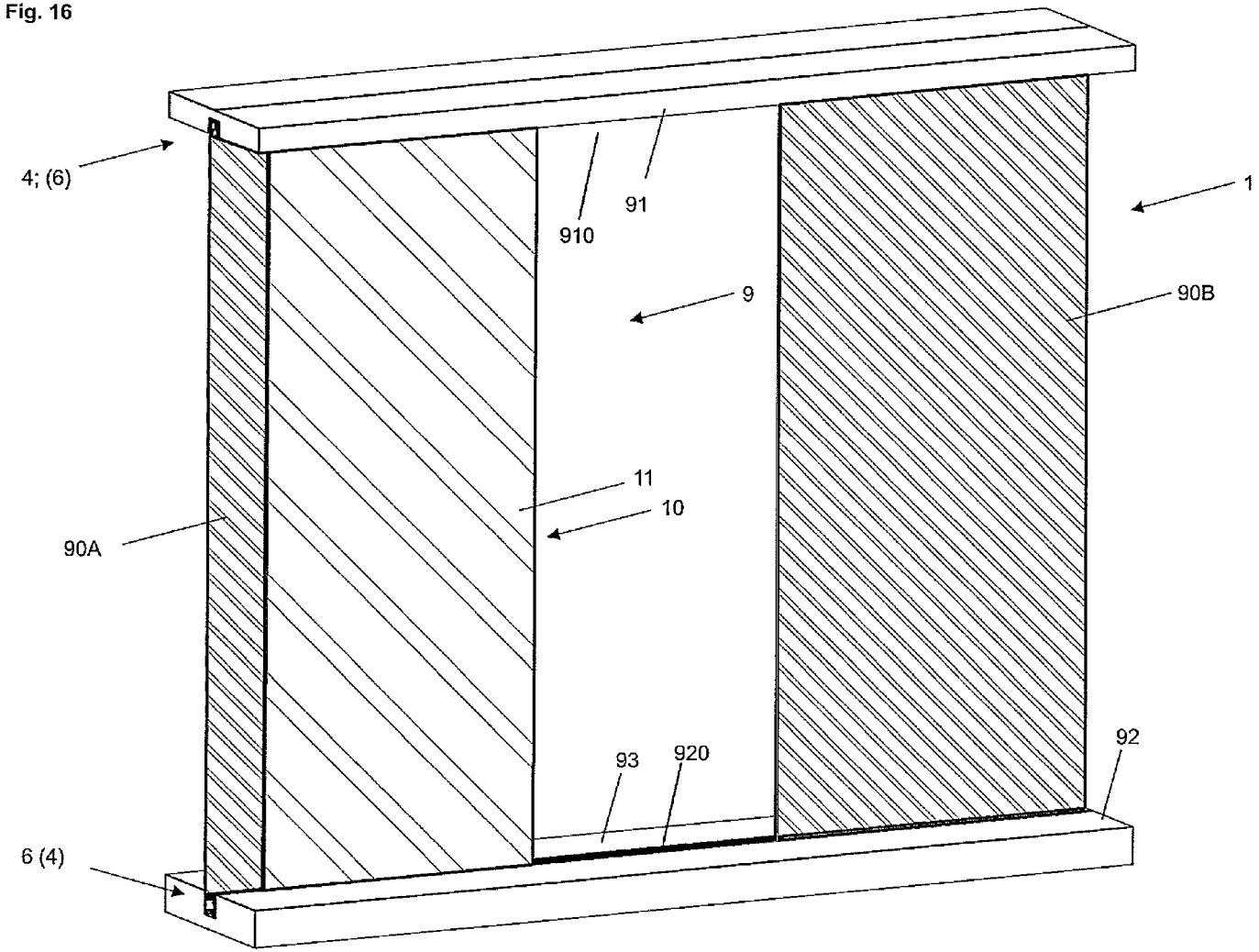
Figure 17:
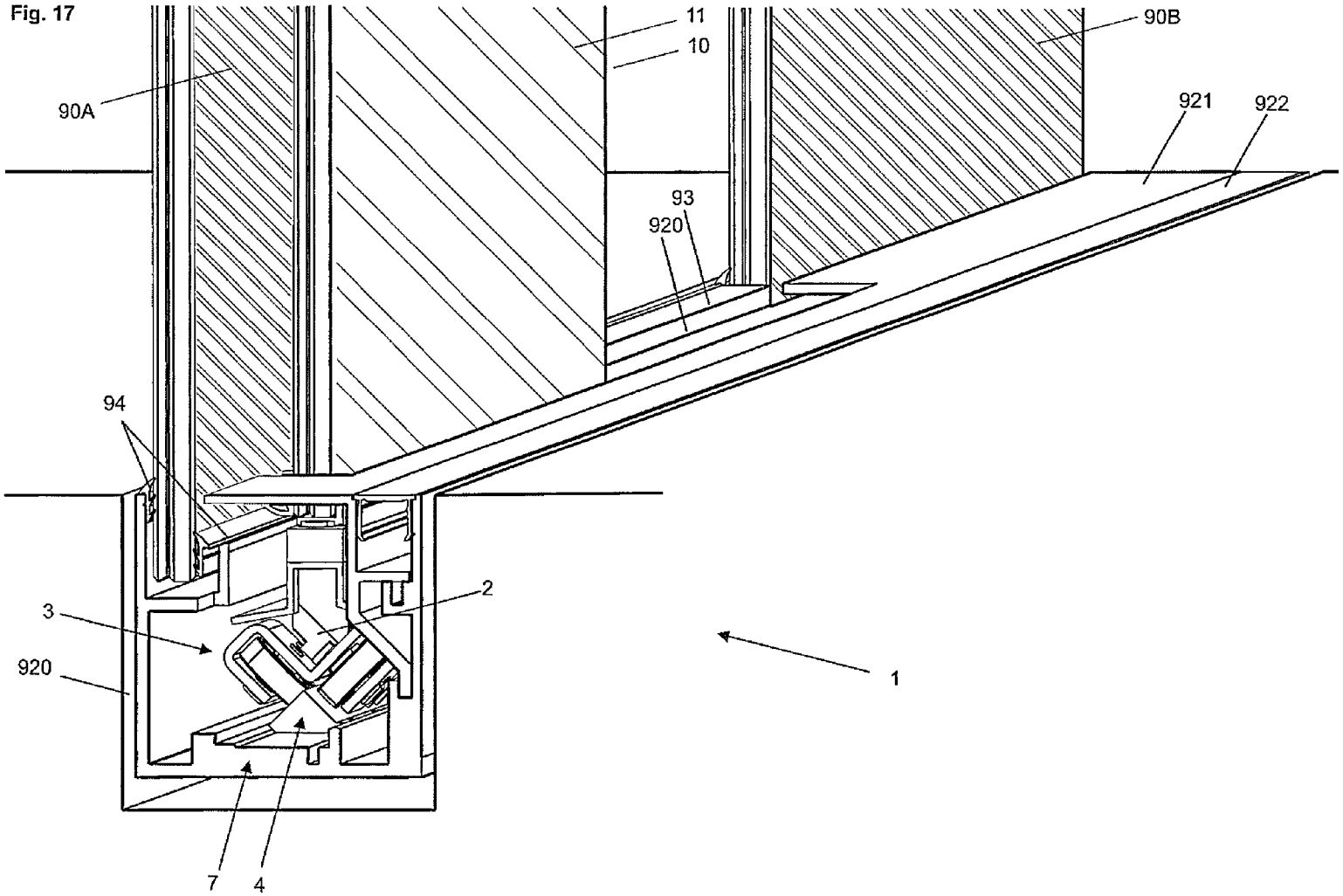
Figures 19B, 20:
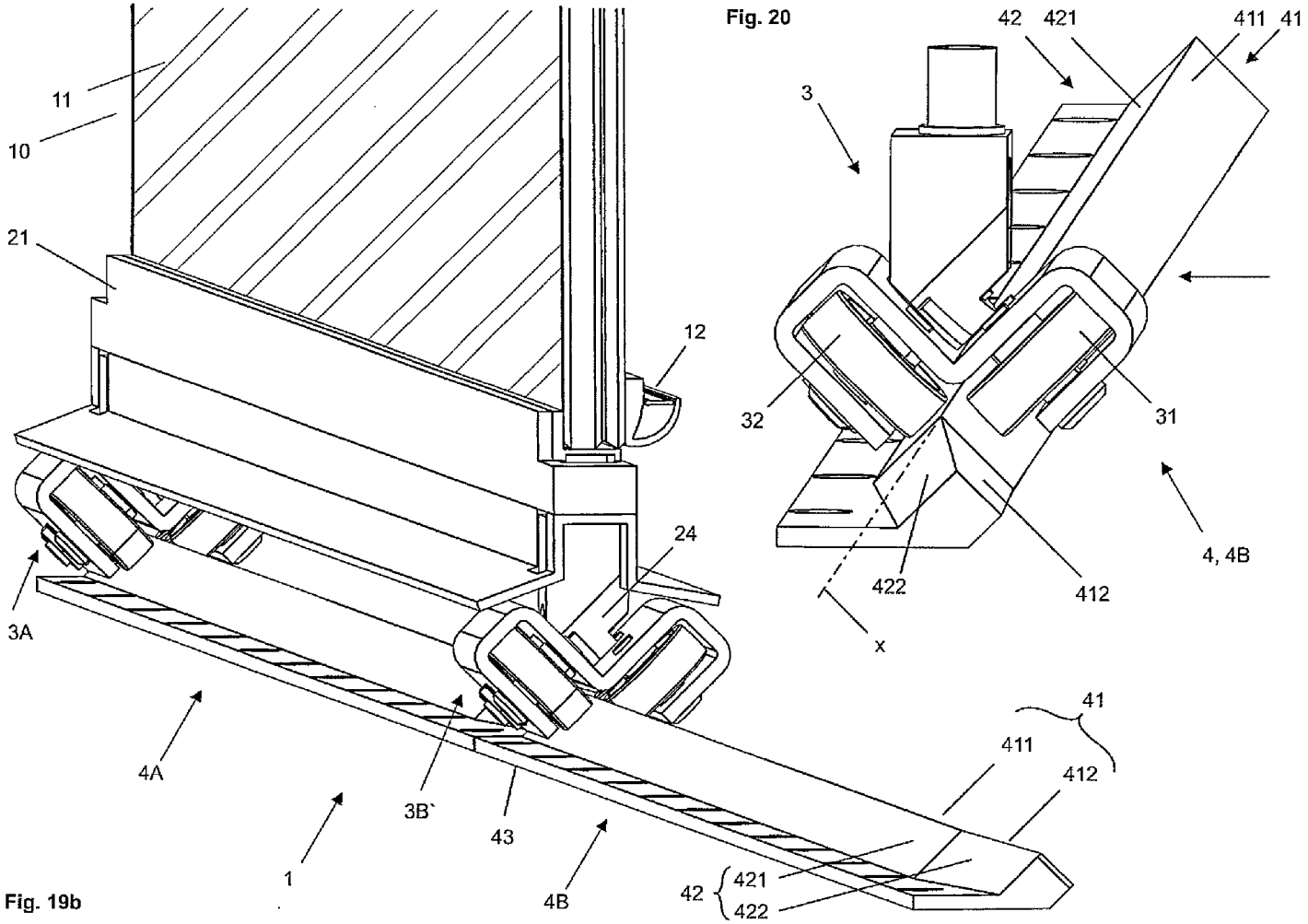
Figure 21:
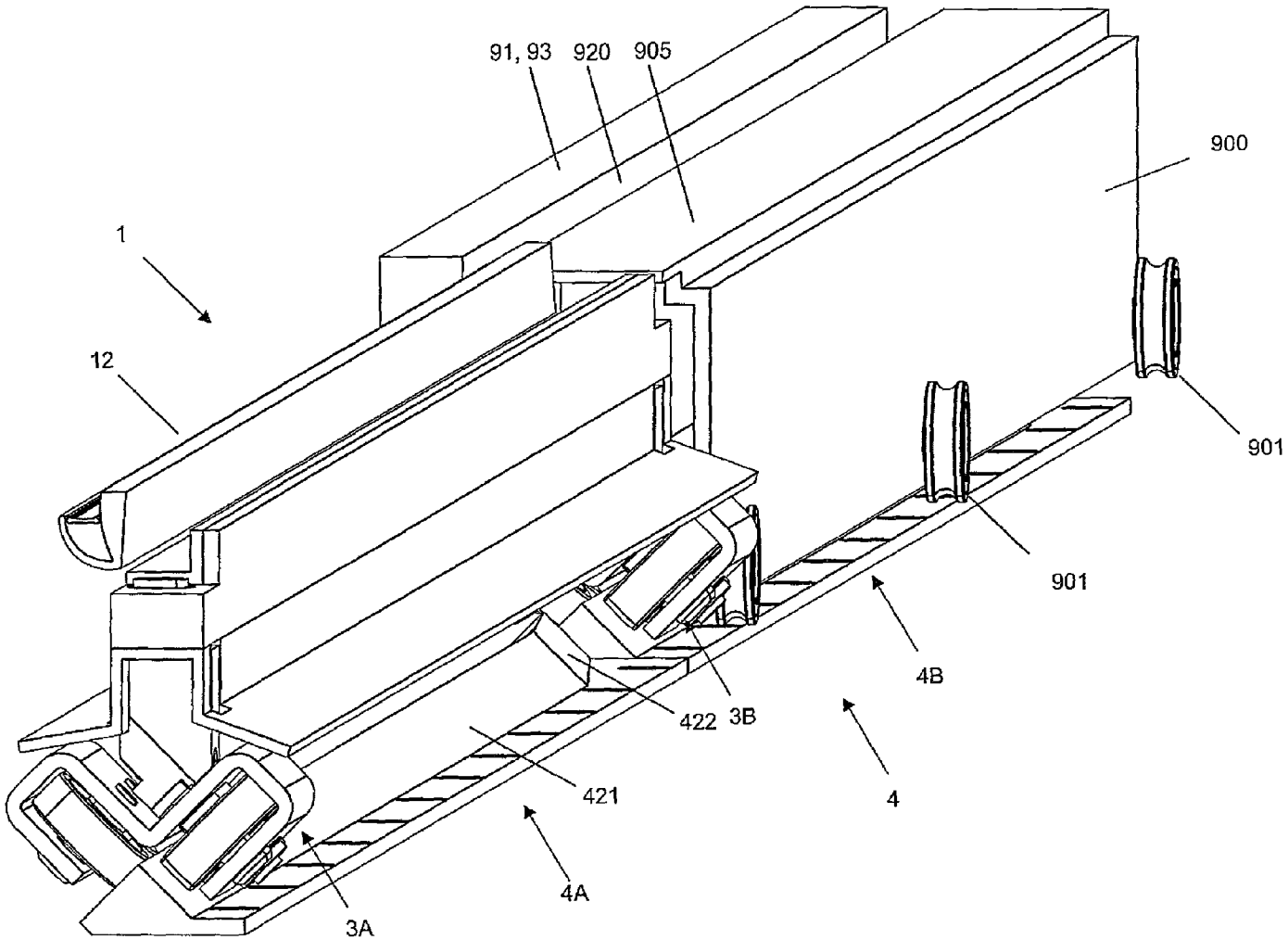
Figure 22A:
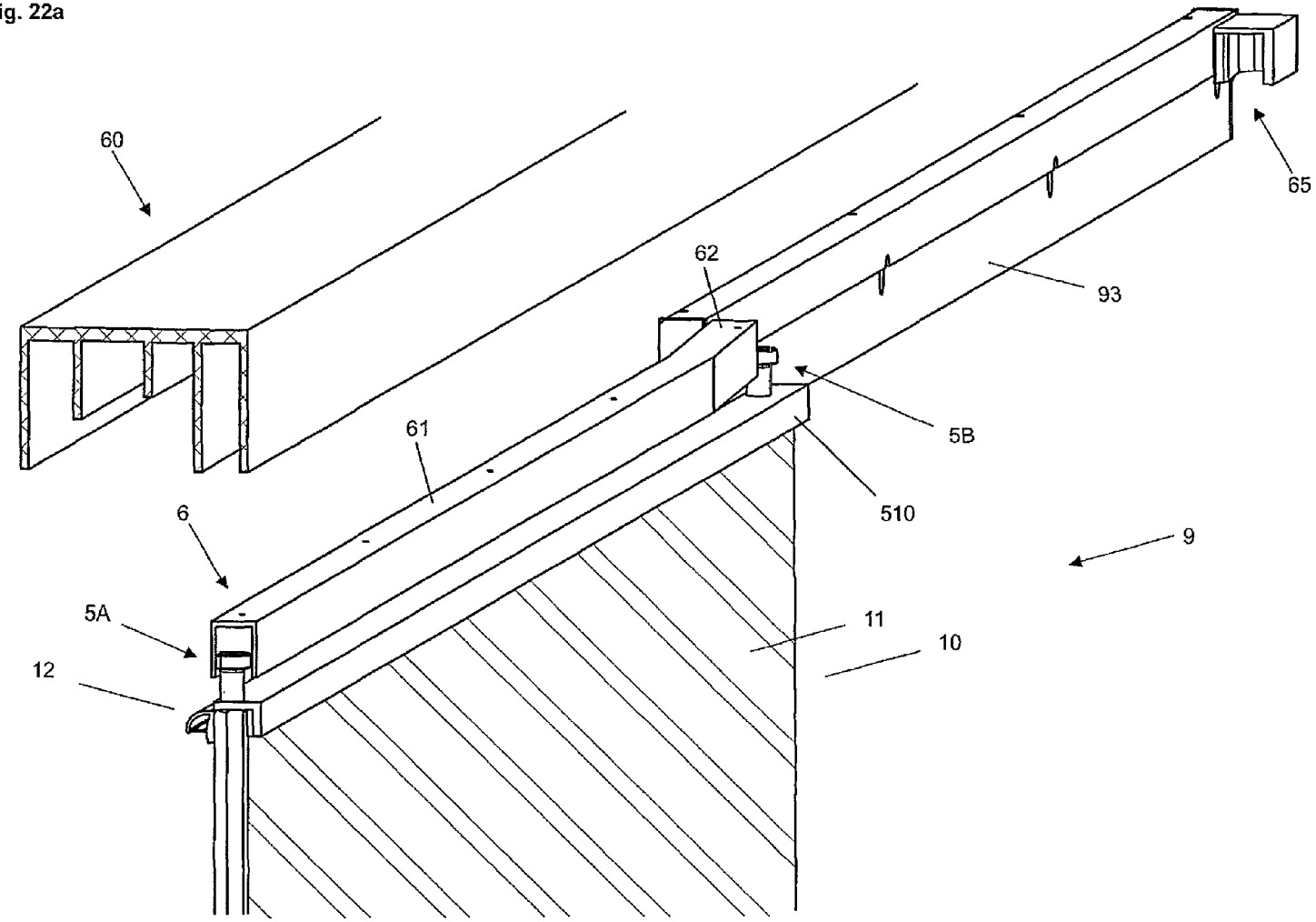
Figure 22B:
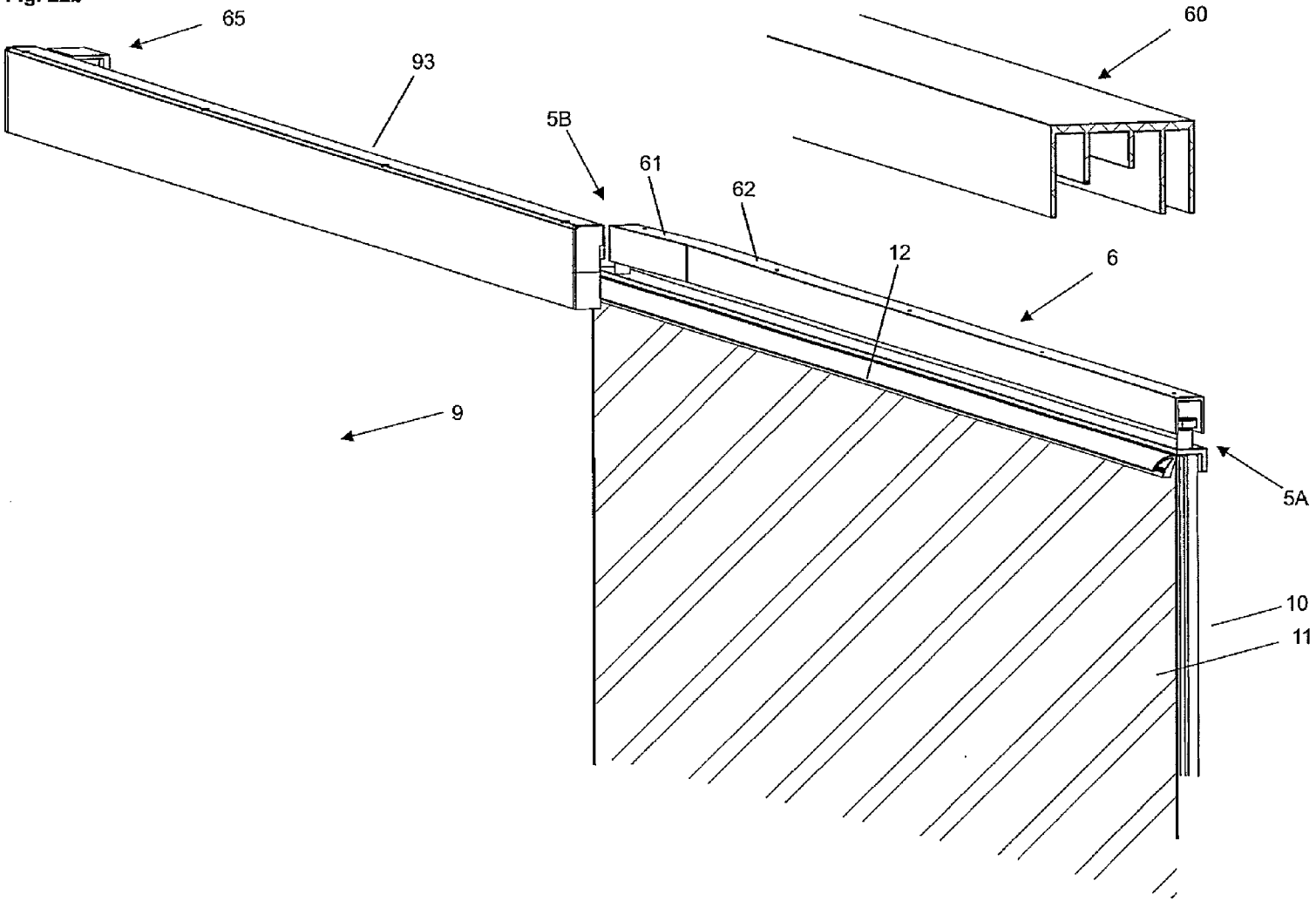

FIG. 7 a running rail 4 with second tracks 42A, 42B or rail segments 4A; 4B as shown in FIG. 5*a* arranged side-by-side and shifted relative to one another;

FIG. 8 an inventive guiding device 1 with a running rail 4 that is held by a mounting profile 7 and on which an inventive carriage 3 is seated;

FIG. 9 the carriage 3 and the coupling device 2 of FIG. 4 separated from one another;

FIG. 9*a* parts of the coupling device 2 shown in FIG. 9;

FIG. 10*a-c* the body 33 of the carriage 3 of FIG. 4 in different illustrations with elements 251, 252 of the coupling device 2 and shafts 311, 321 of the roller pairs 31, 32 inserted therein;

FIG. 11 the lower side the sliding door 10 of FIG. 1 with a guide rail 6, in which a first stationary guide carriage 5A is permanently engaged, and a guide fork 65, into which a second stationary guide carriage 5B can engage as soon as the sliding door 10 richest the end position;

FIG. 11*a* the guide rail 6 of FIG. 11 with the stationary first guide carriage 5A engaging therein;

FIG. 11*b* the guide fork 65 of FIG. 11 before the arrival at the second guide carriage 5B;

FIG. 11*c* a guide carriage 5 in sectional view;

FIG. 11*d* a segment 120 of the sealing element 12 of the sliding door 10 shown in FIG. 1;

FIG. 12 a damping device 8 connected to an inventive carriage 3;

FIG. 12*a* in explosion view, the damping device 8 of FIG. 12;

FIG. 13*a-c* an inventive running rail 4 in different inclinations supporting carriages 3 with different carriage bodies 33, 330;

FIG. 14*a-b* in a further preferred embodiment an inventive running rail 4 and an inventive carriage 3, which are serving for supporting a sliding element 10 held above the running rail 4;

FIG. 15 the carriage 3 of FIG. 14*a* with a coupling device 2 with which the carriage 3 is connected with a fitting 21 that holds the door leaf 11;

FIG. 16 a sliding door 10 held by a guiding device 1 and serving for closing a wall opening 9, that is either supported below by a running rail 4 arranged in a floor channel 920 or that is suspended above on a running rail 4 arranged in a ceiling channel 910;

FIG. 17 the guiding device 1 of FIG. 16 with the running rail 4 held by a mounting profile 7 within the floor channel 920 of FIG. 16;

FIG. 18 *a-b* a view into the floor channel 920 of FIG. 17 from the front side and the rear side;

FIG. 19 *a-b* the running rail 4 of FIG. 17 with two rail segments 4A, 4B, on which carriages 3A, 3B are guided that are connected via coupling devices with a fitting strip 21 that holds a door leaf 11;

FIG. 20 the running rail 4 of FIG. 17 with the two tracks 41, 42, which comprise each a first track section 411, 421 running in parallel to the longitudinal axis x and each a second track section 412, 422 running inclined to the longitudinal axis x;

FIG. 21 the running rail 4 of FIG. 17 with the two rail segments 4A, 4B, on which the carriages 3A, 3B are guided and a closing carriage 900 that is guided on the mounting profile 7 of FIG. 17 and that serves for closing the floor channel 920; and FIG. 22 *a-b* the guide rail 6 of FIG. 11 held in a mounting profile 60 arranged within the ceiling channel 910 of FIG. 16, with guide carriages 5A, 5B guided in the guide rail 6 that are connected to a fitting bar 51 mounted on the door leaf 11.

FIG. 1 shows an inventive guiding device 1 in a first embodiment with a sliding door 10, that is partially opened and that is guided by carriages 3 along a running rail 4, which is mounted by means of a mounting profile 7 on a building wall 91. With the sliding door 10 a room opening 9 can be opened or tightly closed. For this purpose, the sliding door 10 can be moved forward until the room opening 9 is completely covered, as shown in FIG. 2. During the closing process in a terminal section along a distance Sxc, the sliding door 10 is not only guided in parallel in front of the room opening 9 (see arrow A), but also over a distance Sy towards the room opening 9 (see arrow B) and over a distance Sz towards the floor 92. Hence, the sliding door 10 covers an edge 111 of the room opening 9 with minimal margin. Consequently already with this positioning of the sliding door 10 a good ceiling of the room opening 9 is achieved.

In order to further improve the sealing, the front side 111 of the sliding door 10 that is facing the room opening 9 is peripherally, preferably adjacent to the edge of the door leaf 11 provided with a sealing gasket 12, which preferably forms a closed rectangular loop. Hence, in the closing position the upper first part 121 of the sealing gasket 12 is guided towards the frame 911 of the room opening 9. On the lower side the sliding door 10, a lower second part 122 of the sealing gasket 12 overlaps the door leaf 11 and touches the floor 92 after the sliding door 10 has been closed. Alternatively, elements of the sealing gasket can be mounted on the frame 911 of the room opening 9 and on the floor 92.

FIG. 3 shows the front side 111 of the sliding door 10 with the sealing gasket 12 mounted thereon by means of mounting elements 123 (see FIG. 11). The sealing gasket 12 can also be embedded in a receiving groove provided in the sliding door or in a receiving groove provided in the frame or edge that is adjoining the room opening 9.

The sealing gasket 12 is preferably an extruded plastic profile that forms for example a hose arranged in a closed loop with at least one sealing chamber. A section 120 of the sealing gasket 12 is shown in a preferred embodiment in FIG. 11*d*. In this embodiment, the sealing gasket 12 comprises a first a sealing member 1210 facing the building wall 91 and a second sealing member 1220 facing the floor 92. The sealing champers are easily compressible, so that the sealing gasket lies planar on the frame 911 of the room opening 9 or at the floor 92 after the sliding door 10 has been closed.

Figure 18B:
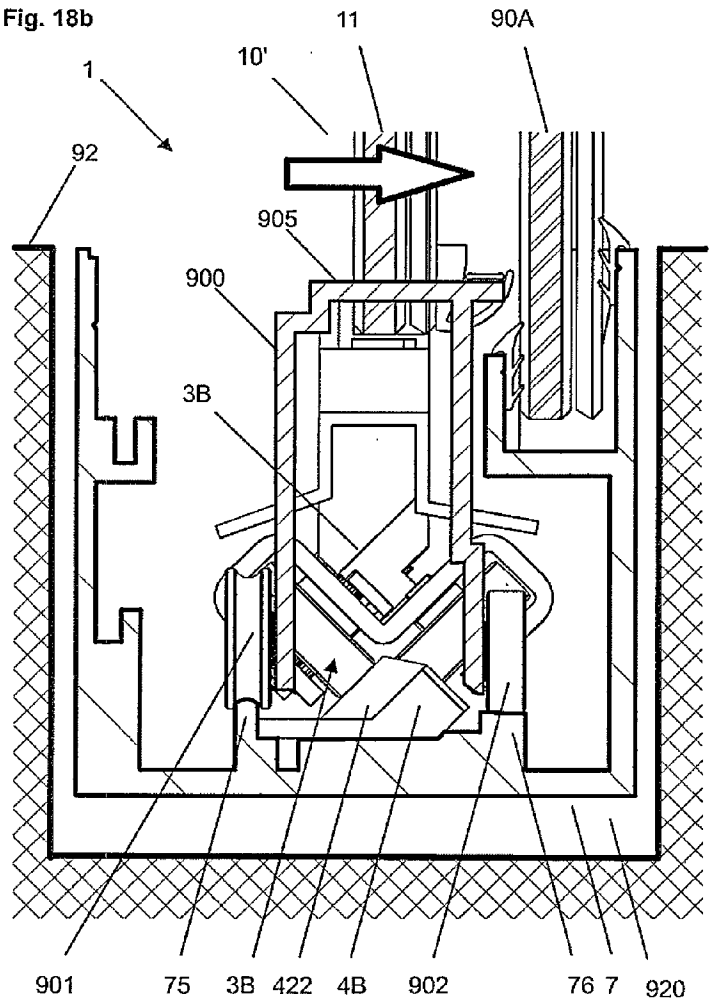
Figure 18A:
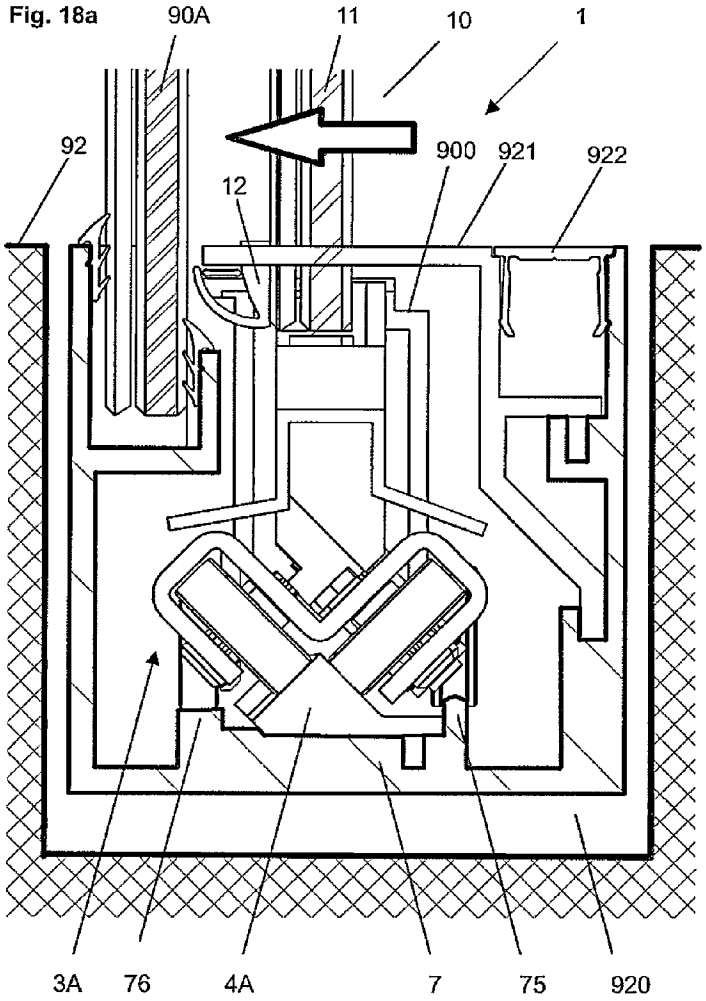

In the embodiment shown in FIG. 18*a* the sealing gasket 12 is arranged completely on the front side of the sliding door 10 and is directed completely against the frame of the room opening 9. Touching the floor with the sealing gasket 12 is avoided. In this embodiment, the sliding door 10 can be operated with further reduced force.

In the closing position of the sliding door 10 the room opening 9 is tightly closed, thus providing optimal insulation with regard to any media. The closed room is optimally protected against external influences, such as sound, odour wind and draft.

In the embodiment of FIG. 1 the sliding door 10 is suspended on a running rail 4. FIG. 17 shows that the sliding door 10 can also advantageously be seated on a running rail 4. Hence, the running elements and guide elements installed at the lower side and the upper side of the sliding door 10 are exchangeable, according to the principal of kinematic reversal.

FIG. 4 shows the sliding door 10 of FIG. 3 that is pivotally connected via a coupling device 2 with the body 33 of an inventive carriage 3, which comprises two roller pairs 31, 32 that are inclined perpendicularly to one another and are directed towards to one another at the lower side. The coupling device 2 comprises a connecting part, i.e. a connecting shaft 23 that is provided with a threading, if appropriate, and that is held in a mounting block 22. The mounting block 22 is anchored in a fitting 21 that is formed as a U-profile and is provided with holding ribs and is held by means of screws in a recess 13 provided at the upper edge of the wooden door leaf 11. This fitting technique is shown as an example only. For glass panels the solution disclosed in [2], U.S. Pat. No. 6,052,867A1, can advantageously be applied. In the shown embodiment the connecting part 23 is held by a coupling element 24, which itself is connected by a pivot 25 with the body 33 of the carriage 3.

FIGS. 5*a*, 5*b* and 5*c* show the inventive carriage 3 of FIG. 4 with a running rail 4 or a segment of a running rail 4 that is mounted above the sliding door 10. The running rail 4 is inclined upwards and comprises a first track 41 for supporting the first roller pair 31 and second track 42 inclined perpendicular thereto for supporting the second roller pair 32 auf. The second track 42 comprises two track sections 421, 422 that are adjacent and inclined towards one another. FIG. 20 shows, that in preferred embodiments, not only one, but both tracks 41 and 42 comprise two track sections 411, 412 and 421, 422 each that are inclined towards one another. This allows a movement of the carriage 3 inclined to the longitudinal axis x the running rail 4 without a vertical movement of the carriage 3.

In the shown embodiment, both first and second tracks 41 and 42, which are facing the sealing, enclose an angle of 90° and are inclined relative to the vertical line by an angle of at least approximately +45° or −45° respectively. As shown in FIG. 5*a*, the roller pairs 31, 32 exhibit a corresponding inclination. It is further shown that the carriage 3 can further be inclined by a correction angle kw preferably in the range of +25° to −22.5°. Further, it is possible to increase the correction angle kw up to 45°, so that the first guide elements carry the load and the second guide elements serve for lateral guidance. With a corresponding inclination of the carriage 3 and the running rail 4 the grade of the lateral and vertical deflection of the sliding door 4 can be set, which further depends on the slope of the second track 42, particularly the inclination of the second track section 422 (see the description relating to FIGS. 13*a*, 13*b* and 13*c*) or the second track sections 412, 422 (see the description relating to FIG. 20).

FIG. 5*b* shows the running rail 4 with the first track 41 that is shown with hatched drawing and on which the first roller pair 31 is seated. The first track 41 lies in a plane that the carriage 3 is consequently following. FIG. 5*b* further shows the second track 42 with the two track sections 421, 422. The second track section 422 can be created in a simple manner by cutting of a part of the running rail 4 perpendicularly to the first track 41.

For the installation of the running rail 4 a mounting strip 43 is provided with mounting bores 431 serving for receiving mounting screws. With the mounting screws the mounting strip 43 is connected with a profile element 71 of a mounting profile 7, as shown in FIG. 8. The mounting profile 7 preferably consists of a plurality of identical profile segments 7A, 7B, . . . and can therefore also be assembled at installation site. For the installation of the mounting profile 7 at a building wall 91, mounting openings 72 are provided through which screws are introduced. The running rail 4 can also be mounted by means of other connection techniques, e.g. by using an adhesive or by casting.

After the installation of the running rail 4, the first track 41 and the first track section 421 of the second track 42 are aligned at least approximately horizontal. Hence, when moving along the first track section 421 the carriage 3 follows a horizontal line or the longitudinal axis of the running rail 4. At the transition from the first to the second track section 421; 422 the carriage 3 turns with its front side that is provided with a damping element 80, with an inclination downwards. This turn is executed unobstructed, since the carriage body 33 is connected to the coupling device 2 or to the angular coupling element 24 via a pivot 25. Hence, the carriage 3 can turn unobstructed and can follow another axis within the plane that is defined by the first track 41. Since the second track section 422 corresponds to a part of the upwards inclined running rail 4, which part is tapered wedge shaped in downward direction, the carriage 3 moves laterally inclined downwards and therefore towards the room opening 9 and the floor 92.

FIG. 5*c* shows the carriage 3 and the running rail 4 of FIG. 5*b* with a view on to the second track 42 on which the track sections 421, 422 are shown with different hatchings.

FIG. 6 shows two carriages 3A, 3B and two rail segments 4A, 4B arranged behind one another of the running rail 4 according to FIG. 5*b*. On the first carriage 3A the coupling device 2 with the coupling element 24 is shown. On the second carriage 3B the coupling element 24 has been disassembled. The carriages 3A, 3B and the rail segments 4A, 4B are designed identical and can be delivered and installed separately. The distance between the carriages 3A, 3B corresponds preferably to the length of the rail segments 4A, 4B that are combined with one another. The distance between the carriages 3A, 3B is selected in such a way that the carriages 3A, 3B are always located within the related rail segments 4A, 4B at corresponding positions and thus are moved synchronously. The terminal stops of the sliding door 10 are arranged in such a way that the carriages 3A, 3B can travel on the thereto assigned rail segments 4A, 4B only.

In order to vary the length of the running path of the sliding door 10 as desired, the running rail 4 shown in FIG. 7 is provided with a second track 42A, 42B arranged side-by-side for each of the carriages 3A, 3B. Hence, the second running elements 32A, 32B of the carriages 3A, 3B are offset relative to one another and are seated on the related track 42A or 42B, respectively. FIG. 13*b* shows a correspondingly designed carriage 3 with a second roller pair 32 that can optionally be moved along the elongated shafts 321' onto the outer or inner track 42A, 42B. A correspondingly designed running rail 4 can be made in one piece or can consist of a plurality of assembled elements. Particularly with this embodiment the running rail 4, the second tracks 42A, 42B can comprise a plurality of inclined second track sections 422A, 422B. Particularly at the ends of the rails inclined second track sections 422A, 422B can be provided. Thereby it is possible to close one of two room openings 9 with the sliding door 10.

FIG. 8 shows the running rail 4 connected to the mounting profile 7 in a preferred embodiment. In this embodiment, the profile elements 4 and 7 can be provided to the simple design. However, the mounting profile 7 and the running rail 4 can also be integrated into one another, so that the mounting profile 7 encloses the running rail 4 in one piece. For this purpose, e.g. the mounting flange 71, which already comprises two inclined surfaces facing upwards, is extended as far as required, e.g. up to the intersecting line of the two tracks 41, 42 of the running rail 4.

FIG. 9 shows the carriage 3 with the disconnected coupling device 2. It is shown that a pivot pin 252, possibly a hollow shaft, extends from the body 33 of the carriage 3 that is pivotally held in a bearing bush 251 (see FIG. 10*c*). The pivot pin 252 corresponds to the mounting bore 241 provided in the coupling element 24. Hence, the coupling element 24, which is firmly connected to the pivot pin 252, is held rotatable relative to the carriage 3.

FIGS. 9 and 9*a* show that in the coupling element 24 a slide 26 is slidably seated. By turning a screw-nut 27, which is connected with a threaded bolt 261 of the slide 26, the slide 26 can be moved forward and backward. The threaded bolt 261 is guided through an opening provided in the coupling element 24. Further, slide 26 comprises a threaded bore 262, in which the connecting element 23 that is anchored in the mounting block 22 is pivotally held (see also FIG. 4). Hence, by shifting the slide 26 and turning the connection element 23 the sliding element 10 can be moved forward and backward as well as upward and downward.

FIGS. 10*a*, 10*b* and 10*c* show a preferred embodiment of the body 33 of the carriage 3 of FIG. 4 in different illustrations (from the backside) with therein introduced elements 251, 252 of the coupling device 2 and shafts 311, 321 provided for holding the roller pairs 31, 32. The shafts 311, 321 comprise each a flange head 3111; 3211 and a piston 3112; 3212. The symmetrical carriage body 33 comprises a carriage block 333 with body bores 3331, 3332 for receiving the first and second shafts 311, 321, which are inserted into the body bores 3331, 3332, until their flange head 3111; 3211 is held by a collar 33310; 33320 that is adjoining the related body bore 3331; 3332 (see FIG. 10*c*).

In the same manner a bushing bore 3333 is provided that runs in parallel to the second shafts 321 and that is limited at the lower side by a collar 33330. Hence, the bearing bush 251 that is provided with a flange ring 2511 can traverse the bushing bore 3333 until the flange ring 2511 is seated on the collar 33330 of the bushing bore 3333, as shown in sectional view in FIG. 10*a*.

As shown in FIG. 10*b*, the shafts 311, 321 of the roller pairs 31, 32 and the bearing bush 251 can therefore be inserted through the carriage block 333 into the mounting positions and can therefore be mounted in a simple manner. While manufacturing of the carriages 3 is significantly simplified in this way and carriages 3 with a compact design result, the weakening of the carriage block 333 caused by the provided bores is insignificant. FIG. 10*b* shows that in addition, even an axial bore 3334 can be provided serving for receiving a damping element 8, 80.

As already shown in FIG. 13*b* the carriage body 33 can consist of the mounting block 330 alone. However, in the preferred embodiments of FIGS. 10*a*, 10*b* and 10*c* the carriage block 333 is provided on each side with a first or second wing element 331; 332. The first region of the first wing element 331 is aligned in parallel to the first body bores 3331 or to the first shafts 311. Then the wing element 331 is aligned perpendicularly thereto so that a first wheel channel 310 is formed. The first shafts 31 traverse the first wheel channel 310 upright and are seated with their ends in wing bores 3311 provided in the first wing element 331. The first region of the second wing element 332 is aligned in parallel to the second body bores 3332 or two the second shafts 321. Then the second wing element 332 is aligned perpendicularly thereto, so that a second wheel channel 320 is formed. The second shafts traverse the second wheel channel 320 upright and are seated with their ends in wing bores 3322 provided in the second wing element 332. The second wing element 332 comprises a further wing bore 3323 serving for additional support of the bearing bush 251. The two wing elements 331 and 332 form a right angled angular element and serve for secure holding of shafts and joint elements. At the same time the roller pairs 31, 32 are protected in the related wheel channel 310, 320.

FIG. 10*c* further shows the pivot pin 252 that is provided with a flange head 2521 and that is pivotally seated in the bearing bush 251.

By means of the running rail 4 and the carriages 3 guided therewith, the sliding door 10 is guided at the upper side in the embodiments described above. To ensure, that the sealing gasket 12 provided at the front side 111 of the door leaf 11 is not only pressed on the upper side but over the whole area equally towards the edge the room opening 9 when the sliding door 10 is closed, preferably also on the lower side are guide elements provided, namely a guide rail 6 and preferably a guide fork 65, into which guide wheels 55 of guide carriages 5A, 5B that are stationary mounted on the floor 92 can engage. The guide rail 6 is embedded into a receiving groove 16 provided at the lower side of the sliding door 10. The guide fork 65 is also arranged within the receiving groove 16, on one end in closing direction.

The guide rail 6, shown from the backside in FIG. 11*a*, comprises a first guide segment 61 running in parallel to the door leaf 11 and a second guide segment 62 that is running inclined thereto and that comprises a length corresponding to the length of the second track section 422 of the second track 42 and therefore to the closing distance Sxc. Hence, the first guide carriage 5A, that engages with the guide wheel 55 in the guide rail 6, reaches the second guide segment 62 in that moment in which the second carriage 3B guided on the running rail 4 reaches the second track section 422. Subsequently the upper side and the lower side of the sliding door 10 are guided synchronously towards the room opening 9. At the same time the second guide carriage 5B engages in the guide fork 65 that is shown in FIG. 11*b* and that comprises a guide channel 652 and guide strips 651, 653 adjoining thereto. The guide strips 651, 653 comprise different thicknesses. Hence, when the guide wheel 55 of the second guide carriage 5B is guided over a ramp of the thicker guide strip 651, then the front side of the sliding door 10 is guided by the second guide carriage 5B and the first carriage 3A, that is supported by the running rail 4, towards the room opening 9 or the building wall 91 respectively.

Based on the principle of kinematic reversal, the device members described above can be exchanged or replaced. E.g., the guide rail 6 and the guide fork 65 can also be mounted stationary on the floor 92 or embedded therein, while guide elements, such as the guide carriages 5A, 5B, are mounted on the lower side of the sliding door 10. Alike, the sealing gasket can be mounted on the wall and not on the door leaf. E.g., a part 121 of the sealing gasket 12 can be mounted on the frame 911 of the door opening 9 and the remaining part 122 of the sealing gasket 12 at the lower side of the sliding door 10.

FIG. 11*c* shows one of the adjustable guide carriages 5 in sectional view. The guide carriage 5 comprises a housing 51 with a tool channel 511. Further, a threaded insert 52 is inserted into the housing 51. Into the threaded insert 52, a threaded part 531 with an eccentrically held bearing axle 53 is inserted that holds on the other side the guide wheel 55. Hence, by turning the threaded part 531, the bearing axle 53 is moving along a circle. The threaded part 531 holds a geared ring 532 that is facing the tool channel 511. Hence, the geared ring 532 can be grasped and turned by a tool, which is introduced into the tool channel 511.

FIG. 11*d* shows the sealing element 12 that has been described above, with the two sealing chambers 1210, 1220.

FIG. 12 shows a damping device 8 that is connected to an inventive carriage 3. With the damping device 8 the run of the sliding door 10 can be damped in the closing region and its potential and/or kinetic energy can be stored in an elastic element. The damping device 8 is held in a recess of the carriage body 33 and directed towards a terminal stop.

FIG. 12*a* shows the individual parts of the damping device 8, mainly a hydraulic damper 81 with a central plunger 811 held in a damping cylinder 812, an elastic element 82, a hollow cylindrical plunger 85 and a damping element 80 made from plastic or rubber that is seated on the central plunger 811 and the hollow cylindrical plunger 85. As soon as the damping element 80 hits the terminal stop, the central plunger 811 and the hollow cylindrical plunger 85 are actuated, causing a reaction of the damping cylinder 812 and tensioning the elastic element 82. The energy stored in the elastic element 82 will be set free again when opening the sliding door 10. Hence, for traversing the closing distance Sxc during the opening process practically no additional force is required.

FIGS. 13*a*, 13*b* and 13*c* show an inventive running rail 4 with different inclinations, supporting carriages 3 that comprise carriage bodies 33, 330 with different designs. The carriage body 330 of the carriage 3 of FIG. 13*b* does not comprise wing elements and consists of the carriage block 333 only. Further, this carriage 3 comprises elongated second shafts 321', along which the second roller pair 32 can be moved inwards or outwards into a position, in which a second track 42, that is assigned to this carriage 3, can be contacted.

As described above, the degree of the lateral and vertical deflection of the carriage 3 can be adjusted with the inclination of the running rail 4. With the inclination shown in FIG. 13*a*, higher vertical and lower lateral deflections of the carriage 3 result. With the inclination shown in FIG. 13*c*, higher lateral and lower vertical deflections of the carriage 3 result. With the inclination shown in FIG. 13*b* the lateral and vertical deflections of the carriage 3 are approximately equal.

FIGS. 14*a* and 14*b* show in a preferred embodiment a running rail 4 mounted on the floor with two tracks 41, 42 that are facing the ceiling, that are inclined towards one another by 90° and that comprise each two track sections 411, 412; 421, 422 that are inclined towards one another. The carriage 3 can be moved forward along the first track sections 411, 412 in parallel to the longitudinal axis x of the running rail 4 up to the second track sections 412, 422 and then along the second track sections 412, 422 inclined to the longitudinal axis x towards the room opening 9. With this embodiment it is possible, to drive the carriage 3 along the second track sections 412, 422 with any positive or negative inclination towards the room opening.

FIG. 14*a* shows the carriage 3 positioned at the beginning of the first track sections 411, 421. FIG. 14*b* shows the carriage 3 at the end of the second track sections 412, 422 close to the room opening 9.

FIG. 15 shows the carriage 3 of FIG. 14*a* that can be connected via a coupling device 2 to a strip-like fitting 21. In this preferred embodiment, the carriage 3 comprises two U-profiles that are connected with one another and that enclose each a wheel channel 310, 320. In the first wheel channel 310 the two first track rollers and in the second wheel channel 320 the two second track rollers are held. The carriage body 33 comprises a pivot pin 242, which can be held in a mounting opening 241 of a coupling element 24. Again, the coupling element 24 and the carriage 3 are pivotally connected with one another. On the other side of the coupling element 24 a bore is provided for receiving a jacket-like connection element 23. The connecting element 23 held, optionally pivotally, on one side in the coupling element 24 and on the other side in a bore 210 provided in the strip-like fitting 21 is therefore holding and supporting the door leaf 11. Hence, again, the carriage 3 is pivotally held relative to the sliding door 10 and can perform the required movements along the running rail 4.

FIG. 16 shows a sliding door 10 that is held by an inventive guiding device 1 and that serves for closing a wall opening 9. The sliding door 10 is either supported below with a running rail 4 embedded in a floor channel 920 or suspended above on a running rail 4 embedded in a ceiling channel 910. FIG. 16 illustrates that the elements of the guiding device 1, the running rail 4 and the guide rail 6 can be exchanged and can be mounted advantageously in a floor channel 920 and in a ceiling channel 910. Further separation elements 90A, 90B, preferably glass panels, are shown that extend into the floor channel 920 below and above into the ceiling channel 910 and which delimit the room opening 9 laterally. It can be seen that the whole closing system with the sliding door 10 can elegantly be designed. The inventive running rail 4 allows the sliding door 10 to be driven precisely between the separation elements 90A, 90B, so that the sliding door 10, together with the separation elements 90A, 90B, forms a planar separation wall. With this embodiment of the guiding device 1, with device parts held in the floor channel 920 and in the ceiling channel 910 and with the door leaf 11 extending into the floor channel 920 and into the ceiling channel 910, further advantages result. The room opening 9 is optimally closed and sealed. A sealing towards the floor and towards the ceiling is no longer required, since the sealing in front of the sliding door 10 towards the edges 91, 93 of the room opening 9 is fully sufficient. Hence, only one sealing plane remains with the advantage that for the operation of the sliding door 10 only minimal handling forces are required.

FIG. 17 shows the guiding device 1 of FIG. 16 with the running rail 4 held in a mounting profile 7 within the floor channel 920 of FIG. 16. Further shown is the separation element 90A that is also held in the mounting profile 7 by means of sealing elements 94. The floor channel 920 is covered with cover elements 921, 922, which leave open only the travel path of the sliding door 10. FIG. 21 shows that this travel path can be closed by means of a closing carriage 900, when the sliding door 10 is moved aside. FIG. 17 further shows a limiting strip 93 held between the separation elements 90A, 90B.

FIGS. 18*a* and 18*b* show the floor channel 920 of FIG. 17 from the front side and the backside.

FIG. 18*a* shows the first rail segment 4A of the running rail 4 that is held within mounting profile 7 and holds the first carriage 3B. It is further shown that the mounting profile 7 comprises rail elements 75, 76, on which the closing carriage 900 is seated.

FIG. 18*b* shows the second rail segment 4B of the running rail 4 that is held within the mounting profile 7 and that holds the second carriage 3B. Further shown is the closing carriage 900 that rolls with wheels 901, 902 on the rail elements 75, 76. The closing carriage 900 comprises a cover plate 905, with which the opening in the floor can be closed after the sliding door 10 has been moved aside.

Figure 19A:
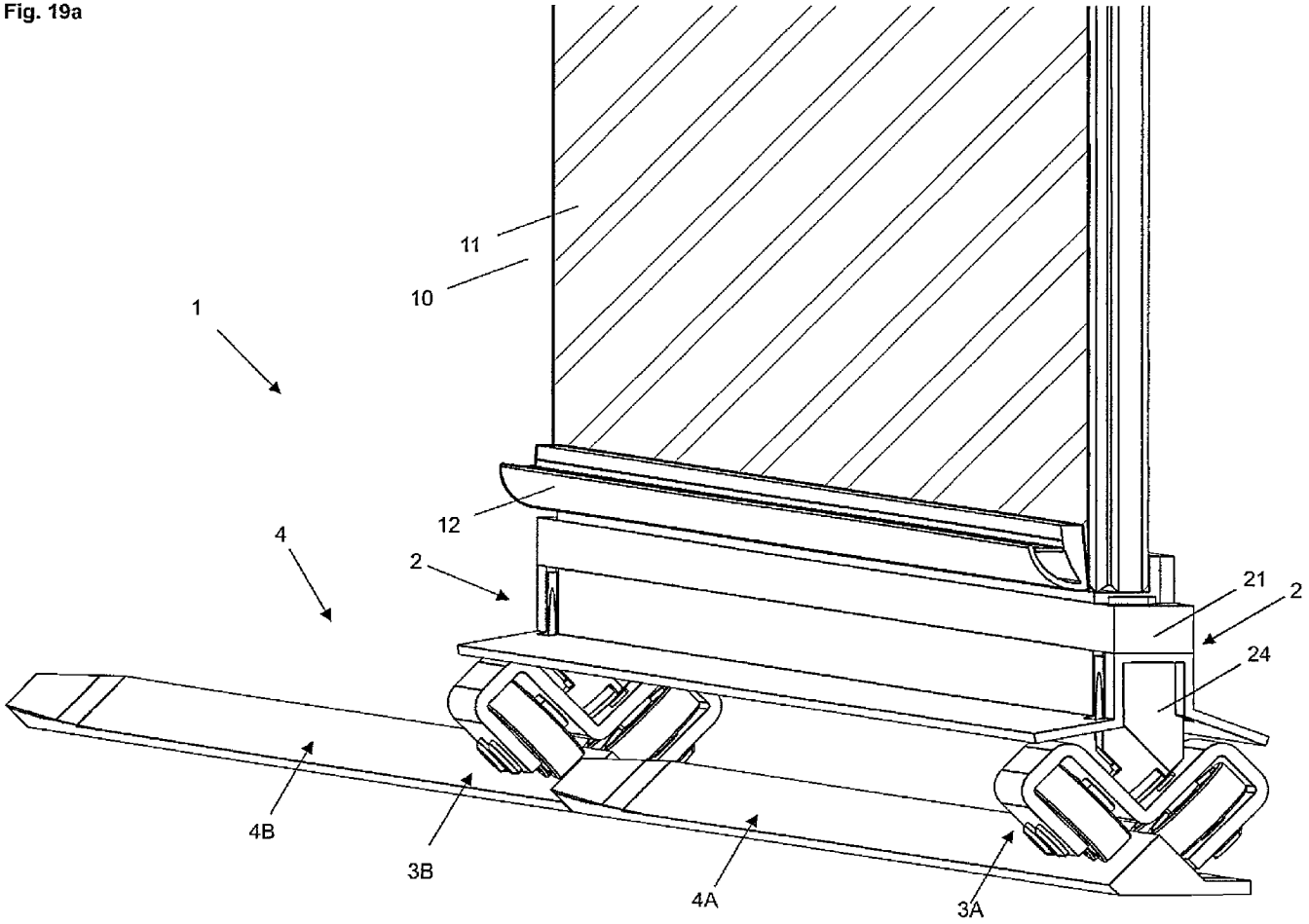

FIGS. 19*a* and 19*b* show the running rail 4 of FIG. 17 with two rail segments 4A, 4B, on which carriages 3A, 3B are guided. The carriages 3A, 3B are connected via coupling devices 2 with a fitting bar 21 that holds a door leaf 11. A strip-like sealing element 12 with a sealing lip is provided at the lower side of the door leaf 11, which sealing element is forwarded during the closing procedure towards the limiting strip 93 shown in FIG. 17.

FIG. 20 shows the running rail 4 of FIG. 17 or the rail segment 4, respectively, with two tracks 41, 42, that comprise each a first track section 411, 421 that are aligned in parallel to the longitudinal axis x and each a second track section 412, 422 that are inclined to the longitudinal axis x.

Further, FIG. 20 shows a carriage 3 that comprises only one first running element or running roller 31 and only one second running element or a running roller 32. In all described embodiments of the inventive guy device 1, inventive carriages 3, 3A, 3B can also be provided with only one first and only one second running element 31, 32.

FIG. 21 shows the running rail 4 of FIG. 17 with the two rail segments 4A, 4B, on which the carriages 3A, 3B are guided. Further shown is the closing carriage 900 of FIGS. 18*a* and 18*b*, which is guided on the mounting profile 7. This closing carriage 900, which comprises the cover plate 905, is moved in front of the room opening 9, when the sliding door 10 is moved aside. Hence, the opening remaining in the floor after removing the sliding door 10 is closed with the cover plate 905 of the closing carriage 900.

If the running rail 4 is mounted on the floor, then the guide rail 6 is mounted on the ceiling preferably in the ceiling channel 910. In embodiment shown in FIGS. 22*a* and 22*b* a frame profile 60 is provided, which serves for receiving the guide rail 6 that comprises two guide segments 61, 62 that are inclined towards one another. Rollers of guide carriages 5A, 5B are guided in the guide rail 6. The guide carriages 5A are connected to a fitting bar 510 that is installed at the upper edge of the door leaf 11. In the closing position of the sliding door 10 the first guide carriage 5A is guided by the second guide segment 62 and the second guide carriage 5B is guided by a guide fork 65, which is mounted on the limiting strip 93, towards the room opening 9. Thereby, the sealing gasket 12 that is comprising a sealing lip, that is connected to the fitting bar 51 and that is facing the room opening 9 is guided towards the limiting strip 93. The sealing gasket can also be mounted on the limiting strip 93 and remains invisible if it is arranged within the ceiling channels 910.

LITERATURE

[1] U.S. Pat. No. 7,891,052B2
[2] U.S. Pat. No. 6,052,867A1

LIST OF REFERENCES

1 guiding device
10 sliding element, sliding door
11 door leaf, e.g. made from glass or wood
111 front side of the door leaf 11
12 sealing gasket
120 sealing element
13 recess in the door leaf 11
121 upper sealing member
1210 first sealing chamber
122 lower sealing member
1220 second sealing chamber
12230 mounting rib
123 mounting material for the sealing gasket 12
16 receiving groove at the lower side of the door leaf 11
2 coupling device
21 fitting
210 bore for receiving the connecting part
22 mounting block
23 connecting part; shaft or jacket
24 coupling element
240 bore for receiving the connecting part
241 bore for receiving the pivot pin 252
25 pivot
251 bearing bush
2511 flange ring
252 pivot pin
2521 flange head
26 slide
261 threaded bolt
262 threaded bore
27 screw-nut
3; 3A, 3B carriages
31 first roller(s); carriage wheels
310 first wheel channel
311 first shafts for the first rollers 31
3111 flange head of the first shaft 311

3112 piston of the first shaft 311
32 second roller(s); carriage wheels
320 second wheel channel
321 shafts for the second rollers 32
321' extended shafts for the second rollers 32
3211 flange head of the second shaft 321
3212 piston of the second shaft 321
33 carriage body
330 carriage body without wing element
331 first wing element
3311 first wing bore for the first shafts 311
332 second wing element
3322 second wing bore for the second shafts 321
3323 third wing bore in the second wing element 332
333 carriage block
3331 first body bore for the first shafts 311
33310 collar for the first shafts 311
3332 second body bore for the second shafts 321
33320 collar for the second shafts 321
3333 bore in the carriage block 333 for the bearing bush
33330 collar for the bearing bush 251
3334 axial bore for receiving the damping device
4 running rail (mounted above or below)
4A, 4B rail segments of the running rail 4
41 first track
42 second track
421 first track section
422 second track section
43 mounting strip
431 bores in the mounting strip
5,5A, 5B guide carriages
51 housing
510 fitting; fitting bar
511 tool channel
52 threaded insert
53 bearing axle
531 threaded part of the bearing axle 53
532 geared ring of the bearing axle 53
55 guide wheels
6 guide rail (mounted below or above)
60 frame profile
61 first guide segment
62 second guide segment
65 guide fork
651 first guide strip
652 guide channel
653 second guide strip
7 mounting profile
7A, 7B profile segments
71 mounting flange
72 bore for receiving a mounting screw
75, 76 rail elements
8 damping device
80 damping element
81 hydraulic damper
811 central plunger
812 damping cylinder
82 elastic element
85 hollow cylindrical plunger
9 room opening, door opening
90 building part
90A, 90B separation elements, glass walls
900 closing carriage
901, 902 wheels of the closing carriage 900
905 cover plate of the closing carriage 900
91 edge of the room opening 9
910, 920 building channel; ceiling channel or floor channel
911 wall edge covered by the sealing gasket 12
92 floor
921, 922 cover elements
93 limiting strip
94 sealing elements

The invention claimed is:

1. A guiding device for a sliding element, such as a sliding door provided with a door leaf, with which a room opening of a building part can be closed at least approximately tightly, the guiding device comprising:

a running rail having a longitudinal axis;

the running rail having a first rail segment and a second rail segment;

a first carriage guided on the first rail segment and a second carriage guided on the second rail segment;

each of the first rail segment and the second rail segment having a first track and a second track that run in parallel and that are inclined towards one another;

at least one of the first track and the second track of each of the first rail segment and the second rail segment comprises a first track surface section and a second track surface section arranged one in front of another in a direction of the longitudinal axis, the first track surface section running in the direction of the longitudinal axis, and the second track surface section extending from the first track surface section and running inclined relative to the first track surface section along the longitudinal axis;

each of the first carriage and the second carriage having a carriage body, each of the carriage bodies holding at least one first roller and at least one second roller that are inclined towards one another and that are supported by the first track and the second track of a respective one of the first rail segment and the second rail segment, the at least one first roller or the at least one second roller being configured to ride in contact with the first track surface section and the second track surface section; and a coupling device pivotally connected with the carriage body of each of the first carriage and the second carriage permitting the first carriage and the second carriage, respectively, to tilt forwards and backwards, the coupling device being configured to be coupled with the sliding element.

2. The guiding device according to claim 1, wherein the running rail, above or below the sliding element, a) is connected directly to the building part, or b) is held in a mounting profile, or c) is arranged in a building channel.

3. The guiding device according to claim 2, wherein the carriage body comprises a first wheel channel, in which one of the at least one first roller is held, and a second wheel channel, in which one of the at least one second roller is held.

4. The guiding device according to claim 3, wherein each of the at least one first roller, which is aligned parallel to and seated on the first track, is held by a first shaft that extends from the carriage body or is held in the first wheel channel, and each of the at least one second roller, which is aligned parallel to and seated on the second track, is held by a second shaft that extends from the carriage body or is held in the second wheel channel.

5. The guiding device according to claim 1, wherein the coupling device, which is arranged below or above the carriage body, is coupled pivotally or firmly with a fitting that holds the sliding element.

6. The guiding device according to claim 1, wherein the first rail segment and the second rail segment are held by the mounting profile or wherein the first rail segment and the second rail segment are unitarily connected with one another.

7. The guiding device according to claim 6, wherein the first track and the second track are directed towards a ceiling, and the first track is inclined relative to a vertical line with an angle in the range of 22.5°-90° or the first track and the second track of the running rail enclose an angle of at least approximately 90°.

8. The guiding device according to claim 6, wherein the running rail comprises or the first rail segment and the second rail segment comprise a common first track and an individual second track for each of the first carriage and the second carriage, which second tracks are arranged side by side or behind one another.

9. The guiding device according to claim 1, wherein the inclination of the second track section relative to the first track section of the first track and/or the inclination of the second track section relative to the first track section of the second track are selected in such a way that the sliding element, within a closing path that corresponds to a length of the second track section, traverses on the one hand a distance between a front side of the sliding element and a frame of the room opening and on the other hand a distance between a lower side of the sliding element and a floor bordering the room opening.

10. The guiding device according to claim 1, further comprising:

a guide rail on a side of the sliding element that is opposite to a side of the sliding element where the running rail is installed, the guide rail slidably holding at least one guide carriage that is connected to the sliding element, the guide rail comprising a first guide segment that runs in parallel to the first track section of the running rail and a second guide segment that runs at least approximately in parallel to the second track section of the running rail.

11. The guiding device according to claim 1, wherein a front side of the sliding element facing the room opening or an edge of the room opening is provided at least partially with a sealing gasket, which in a closing position of the sliding element is held between the sliding element and the edge of the room opening or a limiting strip.

12. The guiding device according to claim 11, wherein the sealing gasket comprises one or a plurality of segments or forms a closed loop.

13. The guiding device according to claim 1, further comprising a pivot member that provides the pivotal connection between the coupling device and the carriage body.

14. The guiding device according to claim 1, wherein the coupling device pivots relative to the carriage body as the carriage body moves from the first track section to the second track section.

15. The guiding device according to claim 14, wherein the sliding element moves in a first plane as the carriage body moves along the first track section, and the pivoting of the coupling device relative to the carriage body as the carriage body moves from the first track section to the second track section moves the sliding element out of the first plane.

16. The guiding device according to claim 2, wherein the at least one first roller comprises two of the first rollers and the at least one second roller comprises two of the second rollers, the carriage body comprising a first wheel channel, in which the two first rollers are held, and a second wheel channel, in which the two second rollers are held.

* * * * *